US006497926B1

(12) United States Patent
Yokota et al.

(10) Patent No.: US 6,497,926 B1
(45) Date of Patent: Dec. 24, 2002

(54) METHOD OF PRODUCING INFORMATION RECORDING MATERIAL

(75) Inventors: Yasuro Yokota, Tokyo (JP); Toshihito Maruyama, Tokyo (JP)

(73) Assignee: Mitsubishi Paper Mills Ltd., Tokyo (JP)

( * ) Notice: Subject to any disclaimer, the term of this patent is extended or adjusted under 35 U.S.C. 154(b) by 0 days.

(21) Appl. No.: 09/609,695

(22) Filed: Jul. 6, 2000

(30) Foreign Application Priority Data

| | | |
|---|---|---|
| Jul. 7, 1999 | (JP) | 11-193318 |
| Oct. 18, 1999 | (JP) | 11-294834 |
| Nov. 11, 1999 | (JP) | 11-321640 |
| Nov. 11, 1999 | (JP) | 11-321641 |

(51) Int. Cl.[7] ..... B05D 1/30

(52) U.S. Cl. ..... 427/542; 427/541; 427/553; 427/557; 427/395; 427/411; 427/420

(58) Field of Search ..... 427/541, 542, 427/557, 420, 395, 411, 419.3, 553; 118/DIG. 4

(56) References Cited

U.S. PATENT DOCUMENTS 4,569,863 A * 2/1986 Koepke et al. ..... 427/402
5,380,644 A * 1/1995 Yonkoski et al. ..... 430/617
5,881,476 A * 3/1999 Strobush et al. ..... 34/451

FOREIGN PATENT DOCUMENTS

| | | |
|---|---|---|
| JP | 43-4160 | 2/1968 |
| JP | 45-14039 | 5/1970 |
| JP | 49-24133 | 6/1974 |

* cited by examiner

*Primary Examiner*—Katherine A. Bareford
(74) *Attorney, Agent, or Firm*—Nixon & Vanderhye P.C.

(57) ABSTRACT

Disclosed is a method of producing, with good productivity, information recording materials such as a thermal recording material and an inkjet recording material excellent in coating properties and excellent in various properties. The method comprises forming a coating composition film made of a plurality of coating color layers on a substrate by curtain coating and drying the coating composition film to form part or all of layers for forming an information recording material, and either (1) adjusting the viscosity of each of the coating colors for a plurality of the coating color layers to at least 100 mPa·s and controlling the surface tension of the coating color for a lowermost layer to 18 to 45 mN/m, or (2) controlling the density of the coating color for a layer to be positioned above not to exceed 140% of the density of the coating color for an adjacent layer to be positioned below. The present invention has been completed on the basis of the above findings.

8 Claims, No Drawings

METHOD OF PRODUCING INFORMATION RECORDING MATERIAL

BACKGROUND OF THE INVENTION

1. Field of the Invention

The present invention relates to a method of producing an information recording material, particularly to a method of producing, with good productivity, an information recording material such as a thermal recording material and an inkjet recording material excellent in various properties and excellent in coating qualities in particular.

2. Related Art Statement

Information recording materials having an information-recording layer formed on a substrate are used in broad fields. A variety of recording materials such as a pressure-sensitive recording material, a thermal recording material, a thermal transfer recording material, an inkjet recording material, etc., are practically used as such information recording materials. In recent years, information recording materials having two or more layers formed on a substrate are also used due to demands for higher functions and higher performances.

A thermal recording material is generally a material in which a heat-sensitive recording layer containing a thermally color-formable material is formed on a substrate. An image is formed by heating it with a thermal head, a thermal pen, laser light, or the like. The thermal recording material is disclosed in Japanese Patent Publications Nos. 43-4160, 45-14039 and the like.

The above thermal recording material is advantageous in that a recording can be obtained with a relatively simple unit, that maintenance is easy and that no noise is made, so that it is widely used in the fields of measuring recorders, facsimile machines, computer terminals, labels, automatic vending machines of tickets, etc. In recent years, further, for attaining superior color density and sensitivity, image stability and tones of a plurality of colors, there is practically used a thermal recording material prepared by applying a protective layer, an undercoat layer and two or more heat-sensitive recording layers, in addition to a thermal recording material having a single heat-sensitive recording layer alone.

An inkjet recording method is a method in which fine globules of an ink are ejected from an inkjet recording device and allowed to adhere to an inkjet recording material to form an image or letters. As the above inkjet recording material, a material having no ink receptor layer such as a non-coated paper is sometimes used. However, a material prepared by forming an ink receptor layer on a substrate is used when printing is made on a synthetic resin film having no ink-reception properties or when it is intended to obtain a finer image. With diversification in use, color imaging or higher performances such as faster printing in recent years, a larger amount of an ink is ejected, and a higher-capacity ink absorption and a higher print density come to be required. Since no sufficient performances for the above requirements can be obtained with any conventional single ink receptor layer, an inkjet recording material having two or more ink receptor layers are practically used as well.

In a conventional information recording material having two or more layers laminated on a substrate, each layer is independently formed by application and drying to form the laminated layers, and the application is carried out by a method such as an air knife coating method, a blade coating method, a rod coating method or a reverse roll coating method. However, an information recording material prepared by any one of the above methods has problems that its coating quality is poor, that an upper layer has pin holes caused by infiltration of an upper layer coating color into a lower layer and repellency during application to form the upper layer and that the quality varies due to continuous coating for a long period of time. Moreover, there are problems in a limit to application at a high rate and a decrease in productivity due to application procedures to be carried out a plurality of times.

As compared with these methods, the curtain coating method disclosed in Japanese Patent Publications Nos. 49-24133 and 49-35447 is an application method in which a free-fall curtain of a coating color is formed and allowed to collide with a substrate, and it is known that the curtain coating method is suitable for application at a high rate. Further, since a plurality of layers can be simultaneously formed by forming a coating composition film made of a plurality of coating color layers, the productivity in multi-layer application can be improved to a great extent. In the simultaneous multi-layer application using a curtain coating method, the coating composition film made of a plurality of coating color layers is formed on a substrate, and thereafter, it is required to dry the coating composition film to solidness without disordering the layer structure thereof. In the field of conventional photographic photosensitive materials prepared by simultaneous multi-layer application using a curtain coating method, each coating color contains gelatin as a binder, and coating composition layers are cooled immediately after coating composition solutions are transferred onto a substrate, so that the gelatin in the coating colors gelled and that the coating composition solution are immobilized, whereby no intermingling of the layers takes place.

DISCLOSURE OF THE INVENTION

Under the circumstances, it is an object of the present invention to provide a method of producing an information recording material having at least two layers laminated on a substrate, with good productivity, in which pinholes in an upper layer and the variability in coating qualities, caused by the infiltration of a coating color for the upper layer into a lower layer and repellency during application for forming the upper layer, are inhibited and the information recording material is excellent in coating qualities and are excellent in various properties.

The present inventors have therefore made diligent studies for achieving the above object, and as a result, it has been found that the above object can be achieved by forming a coating composition film made of a plurality of coating color layers on a substrate by curtain coating and drying the coating composition film to form part or all of layers for forming an information recording material, and either (1) by adjusting the viscosity of each of the coating colors for a plurality of the coating color layers to a certain value or above and controlling the surface tension of the coating color for a lowermost layer so as to bring it into a specific range or (2) by controlling the density of the coating color for each layer for forming a plurality of the coating color layers. The present invention has been completed on the basis of the above findings.

That is, (1) according to the present invention, there is provided a method of producing an information recording material having at least two layers laminated on a substrate, which comprises forming a coating composition film made of a plurality of coating color layers on a substrate by curtain coating and drying the coating composition film, to form part or all of layers for forming the information recording material, wherein the coating colors for a plurality of the coating color layers during application have a viscosity of at least 100 mPa·s and the coating color for a lowermost layer of a plurality of the coating color layers has a surface tension of 18 to 45 mN/m (to be referred to as "Production method I of the present invention" hereinafter).

(2) According to the present invention, there is also provided a method of producing an information recording material having at least two layers laminated on a substrate, which comprises forming a coating composition film made of a plurality of coating color layers on a substrate by curtain coating and drying the coating composition film, to form part or all of layers for forming the information recording material, wherein a coating color for a layer to be positioned above has a density which does not exceed 140% of the density of a coating color for a layer to be positioned below and adjacent thereto (to be referred to as "Production method II of the present invention" hereinafter).

PREFERRED EMBODIMENTS OF THE INVENTION

The method of producing an information recording material according to the present invention includes two modes. The Production method I of the present invention will be explained first.

In the Production method I, part or all of the layers for forming an information recording material are formed by forming a coating composition film made of a plurality of coating color layers on a substrate by a curtain coating and drying the coating composition film.

Production method I is suitably used for producing a thermal recording material as an information recording material. While the layers formed by curtain coating are not specially limited in kind, the layers include an undercoat layer, a heat-sensitive recording layer, a protective layer, etc., and a series of these adjacent layers are simultaneously applied in the form of multi-layers by curtain coating. Specific examples of the combination of layers to be formed by simultaneous application in the form of multi-layers include a combination of an undercoat layer and a heat-sensitive recording layer, a combination of a heat-sensitive recording layer and a protective layer, a combination of an undercoat layer, a heat-sensitive recording layer and a protective layer, and some other combination. Further, these combinations include a combination of undercoat layers of two or more different kinds, a combination of heat-sensitive recording layers of two or more different kinds, a combination of protective layers of two or more different kinds, etc., although these combinations are not critical.

In Production method I of the present invention, coating colors for the above layers are adjusted to a viscosity of at least 100 mPa·s for preventing intermingling of layers during the curtain coating. The viscosity of each coating color refers to a value measured with a Brookfield viscometer at a temperature during the application. When coating colors adjusted to the above viscosity are simultaneously applied in the form of multi-layers by a curtain coating method, intermingling of layers is decreased, and there can be formed layers each of which has excellent coating qualities such as a uniform thickness and freedom from occurrence of pinholes, as compared with a case where the layers are formed one by one by a conventional method such as an air knife coating method, a blade coating method, a rod coating method or a reverse roll coating method and dried to form a laminate. When the viscosity of the coating colors is less than 100 mPa·s, intermingling of layers is liable to take place when the coating composition film in the form of a curtain collides with a substrate or during the drying of the coating composition film transferred onto the substrate. After the coating composition film is dried, inter-layer separation or the laminated state of the layers is poor, so that the functions of the layers cannot be sufficiently exhibited. Further, the infiltration of a layer into the substrate or a layer which is formed below the layers to be formed by curtain coating increases, so that the inter-layer separation or the laminated state of the layers is deteriorated. With an increase in the viscosity of each coating color, intermingling of layers decreases so that the inter-layer separation comes to be superior. When the viscosity of each coating color is too high, the viscous force is too high, a point where the coating composition film arrives onto a substrate shifts toward a downstream side with regard to the running direction of the substrate, and an air layer enters between the substrate and the coating composition film, so that the state of application is destabilized in some cases. Particularly preferably, the viscosity of each coating colors is at least 100 mPa·s and does not exceed 2,000 mPa·s. Further, intermingling of layers is decreased as the viscosity difference between/among the coating colors to be applied by curtain coating for forming the layers decreases, and preferably, the viscosity difference between/among the coating colors is 100 mPa·s or less.

In the Production method I, further, the surface tension of the coating color for the lowermost layer of the layers to be applied by curtain coating is adjusted to 18 to 45 mN/m. The surface tension of the lowermost layer has an influence on easiness in transfer of the coating composition film onto a substrate. This surface tension of a coating color refers to a value measured with a tensiometer using a platinum ring at a temperature of the coating color during its application. With a decrease in the surface tension of the coating color for the lowermost layer, the coating composition film is more easily transferred onto a substrate, and the coating composition film can be applied at a higher rate. When the above surface tension is smaller than 18 mN/m, the infiltration into a substrate or a layer formed below the layer to be applied by curtain coating increases, which may deteriorate a layer-separated and laminated state. When the surface tension is greater than 45 mN/m, it is difficult to transfer the coating composition film onto a substrate, so that the application may be impossible, or that, even if the application is possible, no information recording material having good coating quality cannot be obtained in some cases. When the surface tension of the coating color for the lowermost layer is adjusted to 20 to 45 mN/m, desirably, the easiness in the transfer of the coating composition film onto a substrate and the difficulty in infiltration of the lowermost layer into the substrate are well balanced. This surface tension is preferably in the range of 20 to 40 mN/m.

It is particularly preferred to arrange the surface tensions of the coating colors such that layer(s) for forming upper layer(s) have a smaller surface tension than layer(s) for forming lower layer(s), since an information recording material having superior coating quality can be obtained. When a coating color for forming a lower layer has a smaller surface tension than a coating color for forming an upper layer, there is caused a phenomenon that the coating color forming the upper layer is repelled on the coating color forming the lower layer, no uniform coating composition film is formed, and an information recording material is poor in coating quality. When three or more layers are applied simultaneously, it is preferred to arrange the surface tensions of the layers such that the surface tensions gradually decrease from the lowermost layer, i.e., the layer closest to a substrate to the uppermost layer farthest from the substrate.

Although not specially limited, an applicator machine for forming the coating composition film made of a plurality of coating color layers and transferring it onto a substrate includes an extrusion hopper type curtain coater and a slide hopper type curtain coater. The slide hopper type curtain coater disclosed in Japanese patent Publication No. 49-24133, which is used with a photographic photosensitive material, etc., is particularly preferably used. This slide hopper type curtain coater makes it easier to carry out simultaneous multi-layer application.

The viscosities of the coating colors can be adjusted to ranges specified in the present invention, for example, by a method in which a water-soluble polymer such as polyvinyl alcohol, starch or carboxymethyl cellulose or a thickener such as an acrylic emulsion is mixed with a coating color to increase its viscosity, a method in which a solid content in a coating color is increased to increase its viscosity, or a method in which a coating color is diluted to decrease its viscosity.

The surface tensions of the coating colors can be adjusted to the ranges specified in the present invention, for example, by a method in which a coating color is mixed with a proper amount of an anionic surfactant such as a carboxylic acid salt, a sulfonic acid salt, a sulfate or a phosphate, a nonionic surfactant such an ether type, an ether ester type, an ester type or a nitrogen-containing nonionic surfactant or an amphoteric surfactant such as betaine, an aminocarboxylic acid salt or an imidazoline derivative.

In the coating composition film made of a plurality of coating color layers applied onto a substrate with a curtain coater in the Production method I of the present invention, preferably, the density of the coating color for a layer to be positioned above does not exceed 140% of the density of the coating color for a layer to be positioned below and adjacent thereto. The density refers to a value at a temperature of the coating color during the application thereof. The layer to be positioned above and the layer to be positioned below are under on condition in a drying step following the curtain coating of the coating composition film on a substrate.

The coating composition film formed on a substrate by curtain coating gradually proceeds with intermingling of layers immediately after its application. When a coating color for a layer to be positioned above has a larger density than a coating color for an adjacent layer to be positioned below, the coating color for a layer to be positioned above infiltrates the adjacent layer to be positioned below, so that the intermingling of layers is promoted. In particular, when the density of the coating color for a layer to be positioned above exceeds 140% of the density of the coating color for an adjacent layer to be positioned below, the intermingling of layers takes place to an extreme extent, and the functions of the layers constituting an information recording material may be lost in some cases.

When the density of the coating color for a layer to be positioned above exceeds 100% of the density of the coating color for an adjacent layer to be positioned below but does not exceed 140% thereof, the intermingling of layers is promoted to some extent, but sufficient functions of the layers constituting an information recording material can be obtained. Further, when the density of the coating color for a layer to be positioned above is 100% of the density of the coating color for an adjacent layer to be positioned below, desirably, no intermingling of layers caused by a density difference between coating colors takes place. Further, when the density of the coating color for a layer to be positioned above is less than 100% of the density of the coating color for an adjacent layer to be positioned below, particularly desirably, the action of preventing the intermingling of layers is exhibited.

The method of adjusting the density of the coating color for each layer as described above is not specially limited. Specific examples include a method in which the concentration of a coating color is adjusted, a method in which a component having a high density is incorporated into a coating color and a method in which a liquid component which is volatilized in a drying step following the application is incorporated into a coating color.

In the relationship of a substrate with a layer to be positioned above and a layer to be positioned below of a plurality of the coating color layers, a layer closer to the substrate is taken as a layer to be positioned below, and a layer farther from the substrate is taken as a layer to be positioned above. In this case, the coating composition film can be dried in a state where the coating composition film is positioned on an upper side of the substrate, so that an information recording material can be more easily produced. Due to some limitation to the coating color of a layer to be applied, it is difficult to take a layer closer to the substrate as a layer to be positioned below and to take a layer farther from the substrate as a layer to be positioned above in some cases. In such cases, the coating composition film may be dried in a state where the coating composition film is on the lower side of the substrate such that a layer closer to the substrate is a layer to be positioned above and that a layer farther from the substrate is a layer to be positioned below.

In the Production method I of the present invention, preferably, the coating composition film made of a plurality of the coating color layers formed on a substrate with a curtain coater is dried within 2 minutes after its application. The term "drying" means that water or an organic solvent contained in coating colors forming the coating composition film is evaporated so that the fluidity of the coating colors is substantially removed. In the coating composition film formed on a substrate by curtain coating, intermingling of layers gradually proceeds immediately after its application. If it takes a longer time to dry the coating composition film after its application, the intermingling of layers takes to a great extent, and when the drying takes more than 2 minutes after the application, it is difficult to obtain an information recording material excellent in various properties in some cases. For example, in a thermal recording material, an undercoat layer and a heat-sensitive recording layer are simultaneously applied in the form of multi-layers by curtain coating, and if the drying takes more than 2 minutes, there may be caused a state where the undercoat layer and the heat-sensitive recording layer are intermingled, so that the color density may be low. Further, a heat-sensitive recording layer and a protective layer are simultaneously applied in the form of multi-layers by curtain coating, and if the drying takes more than 2 minutes, there may be caused a state where the heat-sensitive recording layer and the protective layer are intermingled so that there may be caused a problem that the barrier properties of the protective layer are low or that defective printing occurs. In an inkjet recording material, intermingling of a plurality of recording layers causes a decrease in color density and a decrease in ink absorption and absorption rate. When the drying takes more than 2 minutes after the application, intermingling of layers is liable to take place, and the function of each layer may not be fully exhibited. When the drying is completed within 2 minutes after the application, the intermingling of layers rarely takes place, the function of each layer can be fully exhibited, and there can be obtained an information recording material excellent in various properties. As the time period required for completion of the drying decreases, there can be obtained an information recording material more excellent in various properties.

The drying method is not critical. Specifically, the drying method includes a method in which hot air is blown, a method in which dehumidified air is blown, a method in which infrared rays are used for irradiation and a method in which microwaves are used for irradiation. Some of these methods may be used in combination.

Of the above drying methods, in the method using hot air blowing or a dehumidified air blowing, the layer structure of the coating color layers forming the coating composition film may be disordered due to an impact of air blown thereto, so that it is preferred to decrease the impact of air blowing so as to make it as small as possible. For decreasing the impact of air blowing, and for completing the drying for a short period of time after the application, essentially, air is heated to a sufficiently high temperature when hot air is used, and water is fully removed from dehumidified air when dehumidified air is used.

Of the above drying methods, the method using infrared rays for irradiation and the method using microwaves for irradiation are preferably used since no impact is exerted on an applied coating composition film. The method using hot air blowing, the method using dehumidified air blowing and the method using irradiation with infrared rays are disadvantageous to some extent in view of maintaining the stability of layer structure of the coating color layers forming the coating composition film, since the drying of a coating composition film surface proceeds earlier than the drying of the interior thereof. The method using irradiation with microwaves is particularly preferred since both the surface and the interior of the coating composition film can be wholly simultaneously dried so that the layer structure of the coating color layers forming the coating composition film is hardly disordered.

In Production method I of the present invention, preferably, the coating composition film made of a plurality of coating color layers formed on a substrate with a curtain coater is dried in a state where an angle formed by the substrate and a horizontal plane is 45 degrees or less. The above angle formed by the substrate and a horizontal plane refers to a gradient of the substrate to the horizontal plane. 0 Degree shows that the substrate is in parallel with the horizontal plane, and 90 degrees shows that the substrate exists in a plane perpendicular to the horizontal plane. In this case, it is not critical whether the coating composition film is formed on the upper side or lower side of the substrate.

In the coating composition film formed on a substrate by curtain coating, intermingling of layers gradually proceeds immediately after its application until the drying is completed, as already described. It is therefore required to carry out the drying in a state where the intermingling of layers hardly proceeds immediately after the application until completion of the drying. When a substrate is inclined with regard to the horizontal plane, the coating composition film applied onto the substrate is liable to flow toward a lower side along the substrate in parallel with the substrate due to gravity. When the coating composition film made of a plurality of coating color layers flows along a substrate, the flow rate may differ from one layer to another due to a viscosity difference among layers, the flow rate of a layer closer to the substrate may differ from the flow rate of a layer father from the substrate due to a friction with the substrate, and the layer structure of the coating composition film may be therefore disordered, so that the intermingling of layers may occur. In the drying method using hot air blowing, the drying proceeds earlier on the coating composition film surface, and there is therefore caused a large difference in the viscosity distribution in the coating composition film, so that a large difference is caused in flow rates and that the intermingling of layers is promoted. It is therefore difficult to obtain an information recording material excellent in various properties. For example, in a thermal recording material, an undercoat layer and a heat-sensitive recording layer are simultaneously applied in the form of multi-layers by curtain coating, and if the undercoat layer and the heat-sensitive recording layer are intermingled, the color density is low. A heat-sensitive layer and a protective layer are simultaneously applied in the form of multi-layers by curtain coating, and if the heat-sensitive recording layer and the protective layer are intermingled, the barrier properties of the protective layer are low or that defective printing occurs. In an inkjet recording material, intermingling of a plurality of ink receptor layers causes a decrease in color density and a decrease in ink absorption and absorption rate. When layers are intermingled as described above, it is difficult to allow each layer to exhibit its full functions.

The above intermingling of layers caused by the flow of coating composition film increases with an increase in the gradient of the substrate, so that the intermingling of the layers can be prevented by drying the coating composition film in a state where the substrate is so positioned as to be as horizontal as possible. When the coating composition film is dried in a state where the angle formed by the substrate and the horizontal plane is 45 degrees or less, the intermingling of layers can be prevented to such an extent that the properties of an information recording material are not impaired. Further, when the coating composition film is dried in a state where the angle formed by the substrate and the horizontal plane is 20 degrees or less, particularly preferably, there can be obtained an information recording material nearly as excellent in properties as that obtained by carrying out the drying in a state where the substrate is in a completely horizontal state.

The method of the above drying is not critical. Specifically, the drying method includes a method in which hot air is blown, a method in which dehumidified air is blown, a method in which infrared rays are used for irradiation and a method in which microwaves are used for irradiation. Some of these methods may be used in combination.

Production method II of the present invention will be explained hereinafter.

In Production method II of the present invention, part or all of the layers for forming an information recording material are formed by forming a coating composition film made of a plurality of coating color layers on a substrate by a curtain coating and drying the coating composition film.

Production method II is suitably used for producing a thermal recording material or an inkjet recording material as an information recording material. The layers to be formed by curtain coating are not specially limited. For example, the layers for a thermal recording material include an undercoat layer, a heat-sensitive recording layer and a protective layer. The layers for an inkjet recording material include a plurality of ink receptor layers. A series of these adjacent layers are simultaneously applied in the form of multi-layers by curtain coating. Specific examples of the combination of layers to be formed by simultaneous application in the form of multi-layers include a combination of an undercoat layer and a heat-sensitive recording layer, a combination of a heat-sensitive recording layer and a protective layer, a combination of an undercoat layer, a heat-sensitive recording layer and a protective layer, and some other combination. Further, these combinations include a combination of undercoat layers of two or more different kinds, a combination of heat-sensitive recording layers of two or more different kinds, a combination of protective layers of two or more different kinds, etc. The combination in an inkjet recording material includes a combination of a plurality of ink receptor layers. These combinations are not critical.

The curtain coater for forming the coating composition film made of a plurality of coating color layers on a substrate by curtain coating can be selected from those explained with regard to Production method I of the present invention.

In the coating composition film made of a plurality of coating color layers applied onto a substrate with a curtain coater in the Production method II of the present invention, the density of the coating color for a layer to be positioned above does not exceed 140% of the density of the coating color for a layer to be positioned below and adjacent thereto. The above density refers to a value at a temperature of the coating color during the application thereof. The layer to be positioned above and the layer to be positioned below have the same meanings as those explained in Production method I.

The coating composition film formed on a substrate by curtain coating gradually proceeds with intermingling of layers immediately after its application. When a coating color for a layer to be positioned above has a larger density than a coating color for an adjacent layer to be positioned below, the coating color for a layer to be positioned above infiltrates the adjacent layer to be positioned below, so that the intermingling of layers is promoted. In particular, when the density of the coating color for a layer to be positioned above exceeds 140% of the density of the coating color for an adjacent layer to be positioned below, the intermingling of layers takes place to an extreme extent, and the functions of the layers constituting an information recording material may be lost. When the density of the coating color for a layer to be positioned above exceeds 100% of the density of the coating color for an adjacent layer to be positioned below but does not exceed 140% thereof, the intermingling of layers is promoted to some extent, but sufficient functions of the layers constituting an information recording material can be obtained. Further, when the density of the coating color for a layer to be positioned above is 100% of the density of the coating color for an adjacent layer to be positioned below, desirably, no intermingling of layers caused by a density difference between coating colors takes place. Further, when the density of the coating color for a layer to be positioned above is less than 100% of the density of the coating color for an adjacent layer to be positioned below, particularly desirably, the action of preventing the intermingling of layers is exhibited.

The method of adjusting the density of the coating color for each layer as described above includes those methods explained in Production method I.

In the relationship of a substrate with a layer to be positioned above and a layer to be positioned below of a plurality of the coating color layers, a layer closer to the substrate is taken as a layer to be positioned below, and a layer farther from the substrate is taken as a layer to be positioned above. In this case, the coating composition film can be dried in a state where the coating composition film is positioned on an upper side of the substrate, so that an information recording material can be more easily produced. Due to some limitation to the coating color of a layer to be applied, it is difficult to take a layer closer to the substrate as a layer to be positioned below and to take a layer farther from the substrate as a layer to be positioned above in some cases. In such cases, the coating composition film may be dried in a state where the coating composition film is on the lower side of the substrate such that a layer closer to the substrate is a layer to be positioned above and that a layer farther from the substrate is a layer to be positioned below.

In Production method II of the present invention, preferably, coating colors for the above layers are adjusted to a viscosity of at least 100 mPa·s for preventing intermingling of layers during the curtain coating. The viscosity of each coating color refers to a value measured with a Brookfield viscometer at a temperature during the application. When coating colors adjusted to the above viscosity are simultaneously applied in the form of multi-layers by a curtain coating method, intermingling of layers is decreased, and there can be formed layers each of which has excellent coating qualities such as a uniform thickness and freedom from occurrence of pinholes, as compared with a case where the layers are formed one by one by a conventional method such as an air knife coating method, a blade coating method, a rod coating method or a reverse roll coating method and dried to form a laminate. When the viscosity of the coating colors is less than 100 mPa·s, intermingling of layers is liable to take place when the coating composition film in the form of a curtain collides with a substrate or during the drying of the coating composition film transferred onto the substrate. After the coating composition film is dried, inter-layer separation or the laminated state of the layers is poor, so that the functions of the layers cannot be sufficiently exhibited. Further, the infiltration of a layer into the substrate or a layer which is formed below the layers to be formed by curtain coating increases, so that the inter-layer separation or the laminated state of the layers may be deteriorated. With an increase in the viscosity of each coating color, intermingling of layers decreases so that the inter-layer separation comes to be superior. When the viscosity of each coating color is too high, the viscous force is too high, a point where the coating composition film arrives onto a substrate shifts toward a downstream side with regard to the running direction of the substrate, and an air layer enters between the substrate and the coating composition film, so that the state of application is destabilized in some cases. Particularly preferably, the viscosity of each coating colors is at least 100 mPa·s and does not exceed 2,000 mPa·s. Further, intermingling of layers is decreased as the viscosity difference between/among the coating colors to be applied by curtain coating for forming the layers decreases, and preferably, the viscosity difference between/among the coating colors is 100 mPa·s or less.

In the Production method II, further, the surface tension of the coating color for the lowermost layer of the layers to be applied by curtain coating is preferably adjusted to 18 to 45 mN/m. The surface tension of the lowermost layer has an influence on easiness in transfer of the coating composition film onto a substrate. This surface tension of a coating color refers to a value measured with a tensiometer using a platinum ring at a temperature of the coating color during its application. With a decrease in the surface tension of the coating color for the lowermost layer, the coating composition film is more easily transferred onto a substrate, and the coating composition film can be applied at a higher rate. When the above surface tension is smaller than 18 mN/m, the infiltration into a substrate or a layer formed below the layer to be applied by curtain coating increases, which may deteriorate a layer-separated and laminated state. When the surface tension is greater than 45 mN/m, it is difficult to transfer the coating composition film onto a substrate, so that the application may be impossible, or that, even if the application is possible, no information recording material having good coating quality cannot be obtained in some cases. When the surface tension of the coating color for the lowermost layer is adjusted to 20 to 45 mN/m, more desirably, the easiness in the transfer of the coating composition film onto a substrate and the difficulty in infiltration of the lowermost layer into the substrate are well balanced. This surface tension is preferably in the range of 20 to 40 mN/m.

It is particularly preferred to arrange the surface tensions of the coating colors such that layer(s) to be positioned above have a smaller surface tension than layer(s) to be positioned below, since an information recording material having superior coating quality can be obtained. When a coating color for a layer to be positioned below has a smaller surface tension than a coating color for a layer to be positioned above, there is caused a phenomenon that the coating color layer forming the layer to be positioned above is repelled on the coating color layer forming the layer to be positioned below, no uniform coating composition film is formed, and an information recording material is poor in coating quality. When three or more layers are applied simultaneously, it is preferred to arrange the surface tensions of the layers such that the surface tensions gradually decrease from the lowermost layer, i.e., the layer closest to a substrate to the uppermost layer farthest from the substrate.

The viscosities and surface tensions of the coating colors are adjusted as explained in Production method I.

In the Production method II of the present invention, preferably, the coating composition film made of a plurality of coating color layers formed on a substrate with a curtain coater is dried within 2 minutes after its application like Production method I. The drying is carried out by the method explained in Production process I.

In the Production method II of the present invention, preferably, the coating composition film made of a plurality of coating color layers formed on a substrate with a curtain coater is dried in a state where an angle formed by the substrate and a horizontal plane is 45 degrees or less, like Production method I. The drying is carried out by the method explained in Production method I.

The most preferred embodiment of the method of producing an information recording material, provided by the present invention, satisfies the following requirements (1) to (4) when part or all of the layers for forming an information recording material are formed by forming a coating composition film made of a plurality of coating color layers on a substrate by a curtain coating and drying the coating composition film.

(1) The coating colors for a plurality of the above coating color layers have a viscosity of at least 100 mPa·s during application, and the coating color for the lowermost layer of a plurality of the coating color layers has a surface tension of 18 to 45 mN/m.

(2) The coating color for a layer for forming an upper layer of a plurality of the coating color layers has a density which does not exceed 140% of the density of the coating color for a layer for forming an adjacent lower layer.

(3) The coating composition film made of a plurality of the coating color layers is dried within 2 minutes after it is formed on a substrate.

(4) The coating composition film made of a plurality of the coating color layers is dried in a state where the angle formed by the substrate and a horizontal plane is 45 degrees or less.

In the Production methods (I and II) of the present invention, the coating colors of a plurality of the coating color layers forming the coating composition film to be formed on a substrate may contain additives as required. The additives include a pigment dispersing agent, a thickener, a fluidity improver, an anti-foaming agent, a foaming preventing agent, a release agent, a foaming agent, a penetrating agent, a coloring dye, a coloring pigment, a fluorescent brightener, an antioxidant, an antiseptic, a preservative, a water resistance imparting agent, a wet strength agent and a dry strength agent.

Each of the layers of the information recording material produced by the production method of the present invention may contain a binder as required. Specific examples of the binder include starches, hydroxyethyl cellulose, methyl cellulose, ethyl cellulose, carboxylmethyl cellulose, gelatin, casein, polyvinyl alcohol, modified polyvinyl alcohol, polyacrylic acid, polymethacrylic acid, polyacrylic ester, polymethacrylic ester, sodium polyacrylate, polyethylene terephthalate, polybutylene terephthalate, chlorinated polyether, an allyl resin, a furan resin, a ketone resin, oxybenzoyl polyester, polyacetal, polyether ether ketone, polyether sulfone, polyimide, polyamide, polyamideimide, polyaminobismaleimide, polymethyl pentene, polyphenylene ether, polyphenylene sulfide, polyphenylene sulfone, polysulfone, polyallylate, polyallyl sulfone, polybutadiene, polycarbonate, polyethylene, polypropylene, polystyrene, polyvinyl chloride, polyvinylidene chloride, polyvinyl acetate, polyurethane, a phenolic resin, a urea resin, a melamine resin, a melamine-formalin resin, a benzoguanamine resin, a bismaleimide triazine resin, an alkyd resin, an amino resin, an epoxy resin, an unsaturated polyester resin, a styrene/butadiene copolymer, an acrylonitrile/butadiene copolymer, a methyl acrylate/butadiene copolymer, an ethylene/vinyl acetate copolymer, an acrylic amide/acrylic ester copolymer, an acrylic amide/acrylic ester/methacrylic acid terpolymer, an alkali salt of a styrene/maleic anhydride copolymer, an alkali salt or ammonium salt of an ethylene/maleic anhydride copolymer, and other polyolefin-containing resin. These binders may be used alone or in combination.

The substrate for the information recording material to be produced by the method of producing an information recording material, provided by the present invention, may be transparent, semi-transparent or non-transparent. The substrate includes paper, various non-woven fabrics, woven fabrics, a synthetic resin film, a synthetic resin laminated paper, a synthetic paper, a metal foil, a seramic paper, a glass sheet and composite sheets prepared by combining these, although the substrate shall not be limited thereto. These substrates are used depending upon purposes.

In the information recording material produced by the method of producing an information recording material, provided by the present invention, any layer thereof may contain inorganic and organic pigments such as diatomaceous earth, talc, kaolin, calcined kaolin, calcium carbonate, magnesium carbonate, titanium oxide, zinc oxide, silicon oxide, aluminum hydroxide and a urea-formalin resin; higher fatty acid metal salts such as zinc stearate and calcium stearate; waxes such as paraffin, paraffin oxide, polyethylene, polyethylene oxide, stearic acid amide and castor wax, a dispersing agents such as sodium dioctylsulfosuccinate; a surfactant; and a fluorescent dye.

For improving the information recording material in light resistance, an antioxidant and an ultraviolet absorbent may be incorporated. Examples of the antioxidant include a hindered-amine-containing antioxidant, a hindered-phenol-containing antioxidant and a sulfide-containing antioxidant, although the antioxidant shall not be limited thereto. Examples of the ultraviolet absorbent include organic ultraviolet absorbents such as a benzotriazole-containing ultraviolet absorbent, a salicylic-acid-containing ultraviolet absorbent and a benzophenone-containing ultraviolet absorbent, and inorganic ultraviolet absorbents such as zinc oxide, titanium oxide and cerium oxide, although the ultraviolet absorbent shall not be limited thereto.

A thermal recording material produced according to the method of producing an information recording material, provided by the present invention, contains components which form a color under heat. These components are not critical. For example, the components include a combination of a generally colorless or light-colored electron-donating dye precursor with an electron-accepting compound, a combination of an aromatic isocyanate compound with an imino compound, a combination of a generally colorless or light-colored electron-donating dye precursor with an aromatic isocyanate compound, a combination of a metallic compound with a coordination compound and a combination of a diazonium salt with a coupler. In view of excellence in various properties such as color formability and image stability, it is particularly preferred to use a combination of a generally colorless or light-colored electron-donating dye precursor with an electron-accepting compound, a combination of an aromatic isocyanate compound with an imino compound or a combination of a generally colorless or light-colored electron-donating dye precursor with an aromatic isocyanate compound.

In the thermal recording material produced by the method of producing an information recording material, provided by the present invention, any layer of the thermal recording material may contain a material capable of electrically, magnetically or optically recording information. A surface provided with a heat-sensitive recording layer or a surface opposite thereto may be imparted with the capability of receiving an inkjet recording ink. Further, a surface opposite to a surface provided with a heat-sensitive recording layer may be provided with a back-coating layer for preventing curling or electrostatic charge, and further, this surface may be processed to impart it with adhesiveness. Further, printing with a UV ink, etc., may be carried out on the surface of a heat-sensitive recording layer.

In the thermal recording material produced according to the method of producing an information recording material, provided by the present invention, any layer of the thermal recording material and its substrate may contain a light-heat converting material for printing with laser light.

In an inkjet recording material produced according to the method of producing an information recording material, provided by the present invention, any layer of the inkjet recording material may contain a material capable of electrically, magnetically or optically recording information. Further, a surface opposite to a surface provided with a ink receptor layer may be provided with a back-coating layer for preventing curling or electrostatic charge, and further, this surface may be processed to impart it with adhesiveness.

According to the present invention, infiltration of a coating color for an upper layer into a lower layer, a pinhole caused in an upper layer due to repellency during the application of a coating color for the upper layer and the variability in coating qualities are prevented when an information recording material having at least two layers laminated on a substrate is produced. An information recording material, such as a thermal recording material or an inkjet recording material, which is excellent in coating qualities and excellent in various properties, can be produced.

The present invention will be explained with reference to Examples hereinafter, while the present invention shall not be limited to these Examples. In Examples, "part" stands for "part by weight" and "%" stands for "% by weight" unless otherwise specified.

EXAMPLE 1

(A) Preparation of Coating Color for Undercoat Layer

A mixture solution having the following composition was stirred with a homomixer, to obtain an undercoat layer coating color having a viscosity of 1,000 mPa·s and a surface tension of 30 mN/m.

Undercoat Layer Coating Color:

| | |
|---|---|
| Calcined kaolin (Ansilex, supplied by Engelhard) | 100 parts |
| 50% Styrene-butadiene copolymer latex | 24 parts |
| 10% Startch aqueous solution (MS4600, supplied by Nippon Shokuhin Kako) | 60 parts |
| Sodium polyacrylate | 2 parts |
| Water | 116 parts |
| 30% Polyacrylamide aqueous solution (Polymine AE70 supplied by BASF) | 2.3 parts |
| Fluorine-containing surfactant (Surflon S-111, supplied by Asahi Glass Co., Ltd.) | 0.51 part |

(B) Preparation of Coating Color for Heat-sensitive Recording Layer

A mixture solution having the following composition was dispersed with a ball mill, to obtain dispersions B1, B2 and B3 having a volume average particle diameter of 1 $\mu$m and a dispersion B4 having a volume average particle diameter of 2 $\mu$m.

| | |
|---|---|
| Dispersion B1: | |
| 3-Dibutylamino-6-methyl-7-anilinofluorane | 40 parts |
| 10% Polyvinyl alcohol aqueous solution | 20 parts |
| Water | 40 parts |
| Dispersion B2: | |
| 4,4'-bis(Hydroxyphenyl)sulfone | 80 parts |
| 10% Polyvinyl alcohol aqueous solution | 40 parts |
| Water | 80 parts |
| Dispersion B3: | |
| 2-Benzyloxynaphthalene | 80 parts |
| 10% Polyvinyl alcohol aqueous solution | 40 parts |
| Water | 80 parts |
| Dispersion B4: | |
| Calcium carbonate (Callight SA, supplied by Shiraishi Kogyo) | 80 parts |
| Sodium polyacrylate | 1 part |
| Water | 79 parts |

The above-obtained dispersions B1, B2, B3 and B4, 800 parts of a 10% polyvinyl alcohol aqueous solution, 105 parts of water, 0.67 part of a fluorine-containing surfactant (Surflon S-111, supplied by Asahi Glass Co., Ltd.) and 6.7 parts of a 30% polyacrylamide aqueous solution (Polymine AE70, supplied by BASF) were mixed, to obtain a heat-sensitive recording layer coating color having a viscosity of 1,000 mPa·s and a surface tension of 30 mN/m.

(C) Preparation of Thermal Recording Material

With a slide hopper type curtain coater, the undercoat layer coating color and the heat-sensitive recording layer coating color prepared in the above (A) and (B) were formed into a coating composition film made of an under coat layer coating color as a lower layer and a heat-sensitive recording layer coating color as an upper layer in this order from a lower layer side, and the coating composition film was applied onto a woodfree paper having a basis weight of 60 $g/m^2$ such that the solid application amount for an undercoat layer was 8 $g/m^2$ and that the solid application amount for a heat-sensitive recording layer was 6 $g/M^2$, whereby a thermal recording material was obtained.

EXAMPLE 2

A thermal recording material was obtained in the same manner as in Example 1 except that the 30% polyacrylamide aqueous solution (Polymine AE70, supplied by BASF) used in Example 1 (A) was not added thereby to prepare an undercoat layer coating color having a viscosity of 100 mPa·s and a surface tension of 30 mN/m and that the 30% polyacrylamide aqueous solution (Polymine AE70, supplied by BASF) used in Example 1 (B) was not added thereby to prepare a heat-sensitive recording layer coating color having a viscosity of 100 mPa·s and a surface tension of 30 mN/m.

EXAMPLE 3

A thermal recording material was obtained in the same manner as in Example 1 except that the amount of the 30% polyacrylamide aqueous solution (Polymine AE70, supplied by BASF) used in Example 1 (A) was changed to 3 parts thereby to prepare an undercoat layer coating color having a viscosity of 2,000 mPa·s and a surface tension of 30 mN/m and that the amount of the 30% polyacrylamide aqueous solution (Polymine AE70, supplied by BASF) used in Example 1 (B) was changed to 14 parts thereby to prepare a heat-sensitive recording layer coating color having a viscosity of 2,000 mPa·s and a surface tension of 30 mN/m.

EXAMPLE 4

A thermal recording material was obtained in the same manner as in Example 1 except that the 30% polyacrylamide aqueous solution (Polymine AE70, supplied by BASF) used in Example 1 (B) was not added thereby to prepare a heat-sensitive recording layer coating color having a viscosity of 100 mPa·s and a surface tension of 30 mN/m.

EXAMPLE 5

A thermal recording material was obtained in the same manner as in Example 1 except that the amount of the 30% polyacrylamide aqueous solution (Polymine AE70, supplied by BASF) used in Example 1 (B) was changed to 14 parts thereby to prepare a heat-sensitive recording layer coating color having a viscosity of 2,000 mPa·s and a surface tension of 30 mN/m.

EXAMPLE 6

A thermal recording material was obtained in the same manner as in Example 1 except that the 30% polyacrylamide aqueous solution (Polymine AE70, supplied by BASF) used in Example 1 (A) was not added thereby to prepare an undercoat layer coating color having a viscosity of 100 mPa·s and a surface tension of 30 mN/m.

EXAMPLE 7

A thermal recording material was obtained in the same manner as in Example 1 except that the amount of the 30% polyacrylamide aqueous solution (Polymine AE70, supplied by BASF) used in Example 1 (A) was changed to 3 parts thereby to prepare an undercoat layer coating color having a viscosity of 2,000 mP·s and a surface tension of 30 mN/m.

EXAMPLE 8

A thermal recording material was obtained in the same manner as in Example 1 except that the amount of the 30% polyacrylamide aqueous solution (Polymine AE70, supplied by BASF) used in Example 1 (B) was changed to 6.3 parts thereby to prepare a heat-sensitive recording layer coating color having a viscosity of 900 mPa·s and a surface tension of 30 mN/m.

EXAMPLE 9

A thermal recording material was obtained in the same manner as in Example 1 except that the amount of the 30% polyacrylamide aqueous solution (Polymine AE70, supplied by BASF) used in Example 1 (A) was changed to 2.2 parts thereby to prepare an undercoat layer coating color having a viscosity of 100 mPa·s and a surface tension of 30 mN/m.

EXAMPLE 10

A thermal recording material was obtained in the same manner as in Example 1 except that the 30% polyacrylamide aqueous solution (Polymine AE70, supplied by BASF) used in Example 1 (A) was not added thereby to prepare an undercoat layer coating color having a viscosity of 100 mPa·s and a surface tension of 30 mN/m and that the amount of the 30% polyacrylamide aqueous solution (Polymine AE70, supplied by BASF) used in Example 1 (B) was changed to 0.94 part thereby to prepare a heat-sensitive recording layer coating color having a viscosity of 200 mPa·s and a surface tension of 30 mN/m.

EXAMPLE 11

A thermal recording material was obtained in the same manner as in Example 1 except that the amount of the 30% polyacrylamide aqueous solution (Polymine AE70, supplied by BASF) used in Example 1 (A) was changed to 0.61 part thereby to prepare an undercoat layer coating color having a viscosity of 200 mPa·s and a surface tension of 30 mN/m and that the 30% polyacrylamide aqueous solution (Polymine AE70, supplied by BASF) used in Example 1 (B) was not added thereby to prepare a heat-sensitive recording layer coating color having a viscosity of 100 mPa·s and a surface tension of 30 mN/m.

EXAMPLE 12

A thermal recording material was obtained in the same manner as in Example 1 except that the amount of the fluorine-containing surfactant (Surflon S-111, supplied by Asahi Glass Co., Ltd.) used in Example 1 (A) was changed to 1.2 parts thereby to prepare an undercoat layer coating color having a viscosity of 1,000 mPa·s and a surface tension of 18 mN/m and that the amount of the fluorine-containing surfactant (Surflon S-111, supplied by Asahi Glass Co., Ltd.) used in Example 1 (B) was changed to 11.7 parts thereby to prepare a heat-sensitive recording layer coating color having a viscosity of 1,000 mPa·s and a surface tension of 18 mN/m.

EXAMPLE 13

A thermal recording material was obtained in the same manner as in Example 1 except that the amount of the fluorine-containing surfactant (Surflon S-111, supplied by Asahi Glass Co., Ltd.) used in Example 1 (A) was changed to 1.03 parts thereby to prepare an undercoat layer coating color having a viscosity of 1,000 mPa·s and a surface tension of 20 mN/m and that the amount of the fluorine-containing surfactant (Surflon S-111, supplied by Asahi Glass Co., Ltd.) used in Example 1 (B) was changed to 7.5 parts thereby to prepare a heat-sensitive recording layer coating color having a viscosity of 1,000 mPa·s and a surface tension of 20 mN/m.

EXAMPLE 14

A thermal recording material was obtained in the same manner as in Example 1 except that the amount of the fluorine-containing surfactant (Surflon S-111, supplied by Asahi Glass Co., Ltd.) used in Example 1 (A) was changed to 0.006 part thereby to prepare an undercoat layer coating color having a viscosity of 1,000 mPa·s and a surface tension of 45 mN/m and that the amount of the fluorine-containing surfactant (Surflon S-111, supplied by Asahi Glass Co., Ltd.) used in Example 1 (B) was changed to 0.02 part thereby to prepare a heat-sensitive recording layer coating color having a viscosity of 1,000 mPa·s and a surface tension of 45 mN/m.

EXAMPLE 15

A thermal recording material was obtained in the same manner as in Example 1 except that the amount of the fluorine-containing surfactant (Surflon S-111, supplied by Asahi Glass Co., Ltd.) used in Example 1 (B) was changed to 1.4 parts thereby to prepare a heat-sensitive recording layer coating color having a viscosity of 1,000 mPa·s and a surface tension of 27 mN/m.

EXAMPLE 16

A thermal recording material was obtained in the same manner as in Example 1 except that the amount of the fluorine-containing surfactant (Surflon S-111, supplied by Asahi Glass Co., Ltd.) used in Example 1 (A) was changed to 0.64 part thereby to prepare an undercoat layer coating color having a viscosity of 1,000 mPa·s and a surface tension of 27 mN/m.

EXAMPLE 17

(D) Preparation of Undercoat Layer Coating Color

An undercoat layer coating color having a viscosity of 1,000 mPa·s and a surface tension of 30 mN/m was prepared in the same manner as in Example 1 (A).

(E) Preparation of Coating Color for Heat-Sensitive Recording Layer

A heat-sensitive recording layer coating color having a viscosity of 1,000 mP·s and a surface tension of 27 mN/m was prepared in the same manner as in Example 1 (B) except that the amount of the fluorine-containing surfactant (Surflon S-111, supplied by Asahi Glass Co., Ltd.) used in Example 1 (B) was changed to 1.4 parts.

(F) Preparation of Protective Layer Coating Color

A mixture solution having the following composition was dispersed with a ball mill, to prepare a dispersion F having a volume average particle diameter of 1 $\mu$m.

| Dispersion F: | |
|---|---|
| Aluminum hydroxide (Higilite H42, supplied by Showa Denko K.K.) | 6 parts |
| Sodium polyacrylate | 0.1 part |
| Water | 13.9 parts |

The above-obtained dispersion F, 25 parts of a 40% zinc stearate dispersion, 1,000 parts of a 10% polyvinyl alcohol aqueous solution, 244 parts of water, 0.90 part of a fluorine-containing surfactant (Surflon S-111, supplied by Asahi Glass Co., Ltd.) and 4.0 parts of a 30% polyacrylamide aqueous solution (Polymine AE70, supplied by BASF) were mixed, to prepare a protective layer coating color having a viscosity of 1,000 mPa·s and a surface tension of 25 mN/m.

(G) Preparation of Thermal Recording Material

With a slide hopper type curtain coater, the undercoat layer coating color, the heat-sensitive recording layer coating color and the protective layer coating color prepared in the above (D), (E) and (F) were formed into a coating composition film made of an under coat layer coating color, a heat-sensitive recording layer coating color and a protective layer in this order from a lower layer side, and the coating composition film was applied onto a woodfree paper having a basis weight of 60 g/m$^2$ such that the solid application amount for an undercoat layer was 8 g/m$^2$, that the solid application amount for a heat-sensitive recording layer was 6 g/m$^2$ and that the solid application amount for a protective layer was 2 g/m$^2$, whereby a thermal recording material was obtained.

COMPARATIVE EXAMPLE 1

A thermal recording material was obtained in the same manner as in Example 1 except that the 30% polyacrylamide aqueous solution (Polymine AE70, supplied by BASF) used in Example 1 (A) was not added and that the amount of water was changed to 124 parts thereby to prepare an undercoat layer coating color having a viscosity of 80 mPa·s and a surface tension of 30 mN/m and further except that the 30% polyacrylamide aqueous solution (Polymine AE70, supplied by BASF) used in Example 1 (B) was not added and that the amount of water was changed to 254 parts thereby to prepare a heat-sensitive recording layer coating color having a viscosity of 80 mPa·s and a surface tension of 30 mN/m.

COMPARATIVE EXAMPLE 2

A thermal recording material was obtained in the same manner as in Example 1 except that the amount of the fluorine-containing surfactant (Surflon S-111, supplied by Asahi Glass Co., Ltd.) used in Example 1 (A) was changed to 1.3 parts thereby to prepare an undercoat layer coating color having a viscosity of 1,000 mPa·s and a surface tension of 16 mN/m and that the amount of the fluorine-containing surfactant (Surflon S-111, supplied by Asahi Glass Co., Ltd.) used in Example 1 (B) was changed to 19.6 parts thereby to prepare a heat-sensitive recording layer coating color having a viscosity of 1,000 mPa·s and a surface tension of 16 mN/m.

COMPARATIVE EXAMPLE 3

Attempts were made to obtain a thermal recording material in the same manner as in Example 1 except that the fluorine-containing surfactant (Surflon S-111, supplied by Asahi Glass Co., Ltd.) used in Example 1 (A) was not added thereby to prepare an undercoat layer coating color having a viscosity of 1,000 mPa·s and a surface tension of 47 mN/m and that the fluorine-containing surfactant (Surflon S-111, supplied by Asahi Glass Co., Ltd.) used in Example 1 (B) was not added thereby to prepare a heat-sensitive recording layer coating color having a viscosity of 1,000 mPa·s and a surface tension of 47 mN/m. However, no coating was formed due to high surface tensions, and no thermal recording material was obtained.

COMPARATIVE EXAMPLE 4

(H) Preparation of Undercoat Layer Coating Color

An undercoat layer coating color having a viscosity of 100 mPa·s and a surface tension of 30 mN/m was prepared in the same manner as in Example 1 (A) except that the 30% polyacrylamide aqueous solution (Polymine AE70, supplied by BASF) used in Example 1 (A) was not added.

(I) Preparation of Coating Color for Heat-Sensitive Recording Layer

A heat-sensitive recording layer coating color having a viscosity of 100 mPa·s and a surface tension of 30 mN/m was prepared in the same manner as in Example 1 (B) except that the 30% polyacrylamide aqueous solution (Polymine AE70, supplied by BASF) used in Example 1 (B) was not added.

(J) Preparation of Thermal Recording Material

The undercoat layer coating color prepared in (H) was applied onto a woodfree paper having a basis weight of 60 g/m$^2$ with a rod coater, such that the solid application amount for an undercoat layer was 8 g/m$^2$. Then, the heat-sensitive recording layer coating color prepared in (I) was applied onto the undercoat layer on the woodfree paper with a rod coater, such that the solid application amount for a heat-sensitive recording layer was 6 g/m$^2$.

COMPARATIVE EXAMPLE 5

A thermal recording material was prepared in the same manner as in Comparative Example 4 except that the rod coater used as an applicator for the undercoat layer coating color and the heat-sensitive recording layer coating color in Comparative Example 4 (J) was replaced with an air knife coater.

COMPARATIVE EXAMPLE 6

(K) Preparation of Undercoat Layer Coating Color:

An undercoat layer coating color having a viscosity of 100 mPa·s and a surface tension of 30 mN/m was prepared in the same manner as in Example 1 (A) except that the 30% polyacrylamide aqueous solution (Polymine AE70, supplied by BASF) used in Example 1 (A) was not added.

(L) Preparation of Coating Color for Heat-Sensitive Recording Layer

A heat-sensitive recording layer coating color having a viscosity of 100 mPa·s and a surface tension of 30 mN/m was prepared in the same manner as in Example 1 (B) except that the 30% polyacrylamide aqueous solution (Polymine AE70, supplied by BASF) used in Example 1 (B) was not added.

(M) Preparation of Protective Layer Coating Color

A protective layer coating color having a viscosity of 100 mPa·s and a surface tension of 30 mN/m was prepared in the same manner as in Example 17 (F) except that the 30% polyacrylamide aqueous solution (Polymine AE70, supplied by BASF) used in Example 17 (F) was not added and that the amount of the fluorine-containing surfactant (Surflon S-111, supplied by Asahi Glass Co., Ltd.) used in Example 17 (F) was changed to 0.26 part.

(N) Preparation of Thermal Recording Material

The undercoat layer coating color prepared in (K) was applied onto a woodfree paper having a basis weight of 60 g/m$^2$ with an air knife coater such that the solid application amount for an undercoat layer was 8 g/m$^2$. Then, the heat-sensitive recording layer coating color prepared in (L) was applied onto the undercoat layer on the woodfree paper with an air knife coater such that the solid application amount for a heat-sensitive recording layer was 6 g/m$^2$. Further, the protective layer coating color prepared in (M) was applied onto the heat-sensitive recording layer on the woodfree paper which had already been coated with an undercoat layer and a heat-sensitive recording layer, with an air knife coater such that the solid application amount for a protective layer was 2 g/m$^2$, whereby a thermal recording material was obtained.

Test 1: Printing with Thermal Head

A print having a width of 5 cm and a length of 5 cm was made on each of the thermal recording materials obtained in Examples 1 to 17 and Comparative Examples 1, 2 and 4 to 6 with a thermal facsimile printing test machine (TH-PMD, supplied by Okura Denki K.K.) equipped with a printing head (LH4409, supplied by TDK) at an application pulse of 1.1 milliseconds and an applied voltage of 20 V. Each printed portion was measured for a density with a densitometer (Macbeth RD918). Further, the printed portions were visually observed for non-uniformity of color formation. Tables 1 and 2 show the results.

TABLE 1

| | Print density | Non-uniformity of color formation |
|---|---|---|
| Ex. 1 | 1.38 | No non-uniformity of color formation, and uniform color formation was obtained. |
| Ex. 2 | 1.31 | No non-uniformity of color formation, and uniform color formation was obtained. |
| Ex. 3 | 1.43 | No non-uniformity of color formation, and uniform color formation was obtained. |
| Ex. 4 | 1.29 | No non-uniformity of color formation, and uniform color formation was obtained. |
| Ex. 5 | 1.27 | No non-uniformity of color formation, and uniform color formation was obtained. |
| Ex. 6 | 1.21 | No non-uniformity of color formation, and uniform color formation was obtained. |
| Ex. 7 | 1.33 | No non-uniformity of color formation, and uniform color formation was obtained. |
| Ex. 8 | 1.35 | No non-uniformity of color formation, and uniform color formation was obtained. |
| Ex. 9 | 1.34 | No non-uniformity of color formation, and uniform color formation was obtained. |
| Ex. 10 | 1.28 | No non-uniformity of color formation, and uniform color formation was obtained. |
| Ex. 11 | 1.27 | No non-uniformity of color formation, and uniform color formation was obtained. |

Ex. = Example

TABLE 2

| | Print density | Non-uniformity of color formation |
|---|---|---|
| Ex. 12 | 1.29 | No non-uniformity of color formation, and uniform color formation was obtained. |
| Ex. 13 | 1.34 | No non-uniformity of color formation, and uniform color formation was obtained. |
| Ex. 14 | 1.42 | No non-uniformity of color formation, and uniform color formation was obtained. |

TABLE 2-continued

| | Print density | Non-uniformity of color formation |
|---|---|---|
| Ex. 15 | 1.38 | No non-uniformity of color formation, and uniform color formation was obtained. |
| Ex. 16 | 1.39 | A slightly repulsed portion was found on heat-sensitive recording layer, but uniform color formation was obtained, as a whole. |
| Ex. 17 | 1.20 | No non-uniformity of color formation, and uniform color formation was obtained. |
| CEx. 1 | 1.03 | No non-uniformity of color formation, and uniform color formation was obtained. |
| CEx. 2 | 1.10 | No non-uniformity of color formation, and uniform color formation was obtained. |
| CEx. 4 | 1.08 | Non-uniformity of color formation caused by rod application was found on the entire surface. |
| CEx. 5 | 1.10 | Non-uniformity of color formation caused by air knife was found on the entire surface. |
| CEx. 6 | 0.99 | Non-uniformity of color formation caused by air knife was found on the entire surface. |

Ex. = Example,
CEx. = Comparative Example

As shown in Examples 1 to 17 in Tables 1 and 2, thermal recording materials excellent in coating qualities and excellent in color formability and color formation uniformity can be obtained by adjusting the viscosity of the coating colors to at least 100 mPa·s, adjusting the surface tension of coating colors for the lowermost layers to 18 to 45 mN/m and carrying out curtain coating.

In Comparative Example 1, the coating colors infiltrated a substrate to a great extent due to an extremely low viscosity of the coating colors, and only a low color density was obtained. In Comparative Example 2, the coating color infiltrated a substrate to a great extent due to an extremely low surface tension of the coating color for the lowermost layer, and only a low color density was obtained. In Comparative Example 3, the wetting of the coating colors did not occur due to an extremely high surface tension thereof, and no application of the coating colors was possible. In Comparative Example 4, non-uniformity of color formation caused by rod application was observed on the entire surface, and the coating color for the heat-sensitive recording layer infiltrated the undercoat layer, so that only a low color density was obtained. In Comparative Example 5, non-uniformity of color formation caused by the air knife coater was observed on the entire surface, and the coating color for the heat-sensitive recording layer infiltrated the undercoat layer, so that only a low color density was obtained. In Comparative Example 6, non-uniformity of color formation caused by the air knife coater was observed on the entire surface, the coating color for the heat-sensitive recording layer infiltrated the undercoat layer, and the coating color for the protective layer infiltrated the heat-sensitive recording layer, so that only a low color density was obtained.

EXAMPLE 18

(A) Preparation of Undercoat Layer Coating Color

A mixture solution having the following composition was stirred with a homomixer, and further, the surface tension of the mixture solution was adjusted by adding a fluorine-containing surfactant (Surflon S-111, supplied by Asahi Glass Co., Ltd.) to prepare an undercoat layer coating color having a viscosity of 100 mPa·s, a surface tension of 30 mN/m and a density of 1.44 g/cm$^3$.

| | |
|---|---|
| Titanium oxide (SR-1, supplied by Sakai Kagaku) | 92 parts |
| 50% Styrene-butadiene copolymer latex | 29 parts |
| Sodium polyacrylate | 1 part |
| Water | 78 parts |

(B) Perpration of Coating Color for Heat-sensitive Recording Layer

A mixture solution having the following composition was dispersed with a ball mill, to prepare dispersions B1, B2 and B3 having a volume average particle diameter of 1 $\mu$m and dispersion B4 having a volume average particle diameter of 2 $\mu$m.

| | |
|---|---|
| Dispersion B1: | |
| 3-Dibutylamino-6-methyl-7-anilinofluorane | 40 parts |
| 10% Polyvinyl alcohol aqueous solution | 20 parts |
| Water | 40 parts |
| Dispersion B2: | |
| 4,4'-bis(Hydroxyphenyl)sulfone | 80 parts |
| 10% Polyvinyl alcohol aqueous solution | 40 parts |
| Water | 80 parts |
| Dispersion B3: | |
| 2-Benzyloxynaphthalene | 80 parts |
| 10% Polyvinyl alcohol aqueous solution | 40 parts |
| Water | 80 parts |
| Dispersion B4: | |
| Calcium carbonate (Callight SA, supplied by Shiraishi Kogyo) | 80 parts |
| Sodium polyacrylate | 1 part |
| Water | 79 parts |

The above-obtained dispersion B1, B2, B3 and B4 800 parts of a 10% polyvinyl alcohol aqueous solution and 105 parts of water were mixed, and the surface tension of the mixture was adjusted by adding a fluorine-containing surfactant (Surflon S-111, supplied by Asahi Glass Co., Ltd.), to obtain a heat-sensitive recording layer coating color having a viscosity of 100 mPa·s, a surface tension of 30 mN/m and a density of 1.03 g/cm$^3$.

(C) Preparation of Thermal Recording Material

With a slide hopper type curtain coater, the undercoat layer coating color and the heat-sensitive recording layer coating color prepared in the above (A) and (B) were formed into a coating composition film made of an undercoat layer coating color and a heat-sensitive recording layer coating color in this order from a lower layer side to be brought into contact with a substrate, and the coating composition film was applied onto a woodfree paper having a basis weight of 60 g/m$^2$ such that the solid application amount for an undercoat layer was 8 g/m$^2$ and that the solid application amount for a heat-sensitive recording layer was 6 g/m$^2$, followed by drying with the coated surface facing upward, whereby a thermal recording material was obtained.

EXAMPLE 19

A thermal recording material was obtained in the same manner as in Example 18 except that the drying was carried out with the coated surface facing downward instead of allowing the coated surface to face upward in Example 18 (C).

EXAMPLE 20

(D) Preparation of Undercoat Layer Coating Color

A mixture solution having the following composition was stirred with a homomixer, and further, the surface tension of the mixture solution was adjusted by adding a fluorine-containing surfactant (Surflon S-111, supplied by Asahi Glass Co., Ltd.) to prepare an undercoat layer coating color having a viscosity of 400 mPa·s, a surface tension of 30 mN/m and a density of 1.54 g/cm$^3$.

Undercoat Layer Coating Color:

| | |
|---|---|
| Titanium oxide (SR-1, supplied by Sakai Kagaku) | 106 parts |
| 50% Styrene-butadiene copolymer latex | 34 parts |
| Sodium polyacrylate | 1 part |
| Water | 59 parts |

(E) Preparation of Coating Color for Heat-sensitive Recording Layer

A mixture solution having the following composition was dispersed with a ball mill, to prepare dispersions E1, E2 and E3 having a volume average particle diameter of 1 $\mu$m and a dispersion E4 having a volume average particle diameter of 2 $\mu$m.

| | |
|---|---|
| Dispersion E1: | |
| 3-Dibutylamino-6-methyl-7-anilinofluorane | 40 parts |
| 10% Polyvinyl alcohol aqueous solution | 20 parts |
| Water | 40 parts |
| Dispersion E2: | |
| 4,4'-bis(Hydroxyphenyl)sulfone | 80 parts |
| 10% Polyvinyl alcohol aqueous solution | 40 parts |
| Water | 80 parts |
| Dispersion E3: | |
| 2-Benzyloxynaphthalene | 80 parts |
| 10% Polyvinyl alcohol aqueous solution | 40 parts |
| Water | 80 parts |
| Dispersion E4: | |
| Calcium carbonate (Cailight SA, supplied by Shiraishi Kogyo) | 80 parts |
| Sodium polyacryalte | 1 part |
| Water | 79 parts |

The above-obtained dispersions E1, E2, E3 and E4, 800 parts of a 10% polyvinyl alcohol aqueous solution, 105 parts of water and 2.3 parts of a 30% polyacrylamide aqueous solution (Polymine AE70, supplied by BASF) were mixed, and the surface tension of the mixture was adjusted by adding a fluorine-containing surfactant (Surflon S-111, supplied by Asahi Glass Co., Ltd.), to obtain a heat-sensitive recording layer coating color having a viscosity of 400 mPa·s, a surface tension of 30 mN/m and a density of 1.03 g/cm$^3$.

(F) Preparation of Thermal Recording Material

With a slide hopper type curtain coater, the undercoat layer coating color and the heat-sensitive recording layer coating color prepared in the above (D) and (E) were formed into a coating composition film made of an under coat layer coating color and a heat-sensitive recording layer coating color in this order from a lower layer side to be brought into contact with a substrate, and the coating composition film was applied onto a woodfree paper having a basis weight of 60 g/m$^2$ such that the solid application amount for an undercoat layer was 8 g/m$^2$ and that the solid application amount for a heat-sensitive recording layer was 6 g/m$^2$, followed by drying with the coated surface facing upward, whereby a thermal recording material was obtained.

EXAMPLE 21

(G) Preparation of Coating Color for Second Ink Receptor Layer:

A mixture solution having the following composition was stirred with a homomixer, and the surface tension of the solution was adjusted by adding a fluorine-containing surfactant (Surflon S-111, supplied by Asahi Glass Co., Ltd.), to obtain a second ink receptor layer coating color having a viscosity of 200 mPa·s, a surface tension of 35 mN/m and a density of 1.02 g/cm$^3$.

Second Ink Receptor Layer Coating Color:

| | |
|---|---|
| Synthetic amorphous silica (Mizukasil P78D, supplied by Mizusawa Kagaku) | 28 parts |
| 10% Polyvinyl alcohol aqueous solution | 57 parts |
| Water | 115 parts |

(H) Preparation of Coating Color for First Ink Receptor Layer

A mixture solution having the following composition was stirred with a homomixer, and the surface tension of the solution was adjusted by adding a fluorine-containing surfactant (Surflon S-111, supplied by Asahi Glass Co., Ltd.), to obtain a first ink receptor layer coating color having a viscosity of 200 mPa·s, a surface tension of 35 mN/m and a density of 1.42 g/cm$^3$.

First Ink Receptor Layer Coating Color:

| | |
|---|---|
| Barium sulfate (D-2, supplied by Barite Kogyo) | 69 parts |
| Synthetic resin emulsion (Sumikaflex 401, supplied by Sumitomo Chemical Co., Ltd.) | 20 parts |
| Cationic polymer (Sumilese Resin 1001, supplied by Sumitomo Chemical Co., Ltd.) | 46 parts |
| Water | 65 parts |

(I) Preparation of Inkjet Recording Material

With a slide hopper type curtain coater, the second ink receptor layer coating color and the first ink receptor layer coating color prepared in the above (G) and (H) were formed into a coating composition film made of a second ink receptor layer coating color and a first ink receptor layer coating color in this order from a lower layer side to be brought into contact with a substrate, and the coating composition film was applied onto a woodfree paper having a basis weight of 60 g/m$^2$ such that the solid application amount of the second ink receptor layer coating color was 30 g/m$^2$ and that the solid application amount of the first ink receptor layer coating color was 9 g/m$^2$, followed by drying with the coated surface facing downward, whereby an inkjet recording material was obtained.

EXAMPLE 22

An inkjet recording material was obtained in the same manner as in Example 21 except that the drying was carried out with the coated surface facing upward instead of allowing the coated surface to face downward in Example 21 (I).

EXAMPLE 23

(J) Preparation of Coating Color for Second Ink Receptor Layer:

A mixture solution having the following composition was stirred with a homomixer, and the surface tension of the solution was adjusted by adding a fluorine-containing surfactant (Surflon S-111, supplied by Asahi Glass Co., Ltd.), to obtain a second ink receptor layer coating color having a viscosity of 800 mPa·s, a surface tension of 35 mN/m and a density of 1.03 g/cm$^3$.

Second Ink Receptor Layer Coating Color:

| | |
|---|---|
| Synthetic amorphous silica (Mizukasil P78D, supplied by Mizusawa Kagaku) | 30 parts |
| 10% Polyvinyl alcohol aqueous solution | 60 parts |
| Water | 110 parts |

(K) Preparation of Coating Color for First Ink Receptor Layer

A mixture solution having the following composition was stirred with a homomixer, and the surface tension of the solution was adjusted by adding a fluorine-containing surfactant (Surflon S-111, supplied by Asahi Glass Co., Ltd.), to obtain a first ink receptor layer coating color having a viscosity of 800 mPa·s, a surface tension of 35 mN/m and a density of 1.54 g/cm$^3$.

First Ink Receptor Layer Coating Color:

| | |
|---|---|
| Barium sulfate (D-2, supplied by Barite Kogyo) | 80 parts |
| Synthetic resin emulsion (Sumikaflex 401, supplied by Sumitomo Chemical Co., Ltd.) | 23 parts |
| Cationic polymer (Sumilese Resin 1001, supplied by Sumitomo Chemical Co., Ltd.) | 54 parts |
| Water | 43 parts |

(L) Preparation of Inkjet Recording Material

With a slide hopper type curtain coater, the second ink receptor layer coating color and the first ink receptor layer coating color prepared in the above (J) and (K) were formed into a coating composition film made of a second ink receptor layer coating color and a first ink receptor layer coating color in this order from a lower layer side to be brought into contact with a substrate, and the coating composition film was applied onto a woodfree paper having a basis weight of 60 g/m$^2$ such that the solid application amount of the second ink receptor layer coating color was 30 g/m$^2$ and that the solid application amount of the first ink receptor layer coating color was 9 g/m$^2$, followed by drying with the coated surface facing downward, whereby an inkjet recording material was obtained.

COMPARATIVE EXAMPLE 7

A thermal recording material was obtained in the same manner as in Example 20 except that the drying was carried out with the coated surface facing downward instead of allowing the coated surface to face upward in Example 20 (F).

COMPARATIVE EXAMPLE 8

An inkjet recording material was obtained in the same manner as in Example 23 except that the drying was carried out with the coated surface facing upward instead of allowing the coated surface to face downward in Example 23 (L).

Test 2: Printing on Thermal Recording Material with Thermal Head

A print having a width of 5 cm and a length of 5 cm was made on each of the thermal recording materials obtained in Examples 18 to 20 and Comparative Example 7 with a thermal facsimile printing test machine (TH-PMD, supplied by Okura Denki K.K.) equipped with a printing head (LH4409, supplied by TDK) at an application pulse of 1.1 milliseconds and an applied voltage of 20 V. Each printed portion was measured for a density with a densitometer (Macbeth RD918). Further, the printed portions were visually observed for a color formation state. Table 3 shows the results.

Test 3: Printing on Inkjet Recording Material with Inkjet Printer

A print having a width of 5 cm and a length of 5 cm was made on each of the inkjet recording materials obtained in Examples 21 to 23 and Comparative Example 8 with a black ink with a color inkjet printer (PM750C, supplied by Seiko-Epson). Each printed portion was measured for a density with a densitometer (Macbeth RD918). Further, the printed portions were visually observed for a color formation state. Table 4 shows the results.

TABLE 3

| | Print density | Color formation state |
|---|---|---|
| Ex. 18 | 1.25 | Dense, clear and black color formation was obtained. |
| Ex. 19 | 1.22 | Dense, clear and black color formation was obtained. |
| Ex. 20 | 1.31 | Dense, clear and black color formation was obtained. |
| CEx. 7 | 1.05 | Grayish black color formation was obtained. |

Ex. = Example, CEx. = Comparative Example

TABLE 4

| | Print density | Color formation state |
|---|---|---|
| Ex. 21 | 1.32 | Dense, clear and black color formation without marginal bleeding was obtained. |
| Ex. 22 | 1.34 | Dense, clear and black color formation without marginal bleeding was obtained. |
| Ex. 23 | 1.35 | Dense, clear and black color formation without marginal bleeding was obtained. |
| CEx. 8 | 1.10 | Slightly brownish black color formation with marginal bleeding was obtained. |

Ex. = Example, CEx. = Comparative Example

As shown in Examples 18 to 23 shown in Tables 3 and 4, information recording materials excellent in coating properties and excellent in various properties were obtained by curtain-coating the coating composition films made of a plurality of coating composition layers and adjusting the density of the coating color for a layer to be positioned above of a plurality of the coating color layers such that the density of the layer did not exceed 140% of the density of a layer to be positioned below.

In Comparative Example 7, the undercoat layer and the heat-sensitive recording layer came to be in an intermingled state, and the color former was masked with titanium oxide contained in the undercoat layer, so that only a low color density was obtained. In Comparative Example 8, the second ink receptor layer and the first ink receptor layer came to be in an intermingled state, and the dye contained in the inkjet ink was diffused deep into the ink receptor layer, so that only a low color density was obtained. Further, the ink bled toward circumferences of the print and the margin of the print bled.

EXAMPLE 24

(A) Preparation of Undercoat Layer Coating Color

A mixture solution having the following composition was stirred with a homomixer, to prepare an undercoat layer coating color having a viscosity of 100 mPa·s and a surface tension of 30 mN/m.

Undercoat Layer Coating Color:

| | |
|---|---|
| Calcined kaolin (Ansilex, supplied by Engelhard) | 100 parts |
| 50% Styrene-butadiene copolymer latex | 24 parts |
| 10% Starch aqueous solution (MS4600, supplied by Nippon Shokuhin Kako) | 60 parts |
| Sodium polyacrylate | 2 parts |
| Water | 116 parts |
| Fluorine-containing surfactant (Surflon S-111, supplied by Asahi Glass Co., Ltd.) | 0.51 part |

(B) Preparation of Coating Color for Heat-sensitive Recording Layer

A mixture solution having the following composition was dispersed with a ball mill, to prepare dispersions B1, B2 and B3 having a volume average particle diameter of 1 $\mu$m and a dispersion B4 having a volume average particle diameter of 2 $\mu$m.

| | |
|---|---|
| Dispersion B1: | |
| 3-Dibutylamino-6-methyl-7-anilinofluorane | 40 parts |
| 10% Polyvinyl alcohol aqueous solution | 20 parts |
| Water | 40 parts |
| Dispersion B2: | |
| 4,4'-bis (Hydroxyphenyl) sulfone | 80 parts |
| 10% Polyvinyl alcohol aqueous solution | 40 parts |
| Water | 80 parts |
| Dispersion B3: | |
| 2-Benzyloxynaphthalene | 80 parts |
| 10% Polyvinyl alcohol aqueous solution | 40 parts |
| Water | 80 parts |
| Dispersion B4: | |
| Calcium carbonate (Callight SA, supplied by Shiraishi Kogyo) | 80 parts |
| Sodium polyacryalte | 1 part |
| Water | 79 parts |

The above-obtained dispersions B1, B2, B3 and B4, 800 parts of a 10% polyvinyl alcohol aqueous solution, 105 parts of water and 0.67 part of a fluorine-containing surfactant (Surflon S-111, supplied by Asahi Glass Co., Ltd.) were mixed, to obtain a heat-sensitive recording layer coating color having a viscosity of 100 mPa·s and a surface tension of 30 mN/m.

(C) Preparation of Thermal Recording Material

With a slide hopper type curtain coater, the undercoat layer coating color and the heat-sensitive recording layer coating color prepared in the above (A) and (B) were formed into a coating composition film made of an undercoat layer coating color as a lower layer and a heat-sensitive recording layer coating color as an upper layer, in this order from a lower side to be brought into contact with a substrate, and the coating composition film was applied onto a woodfree paper having a basis weight of 60 g/m$^2$ such that the solid application amount for an undercoat layer was 8 g/M$^2$ and that the solid application amount for a heat-sensitive recording layer was 6 g/m$^2$, followed by drying by blowing hot air at 180° C. for 30 seconds immediately after the application, whereby a thermal recording material was obtained.

EXAMPLE 25

A thermal recording material was obtained in the same manner as in Example 24 except that the drying was carried out by blowing hot air at 120° C. for 1 minute instead of blowing the hot air at 180° C. for 30 seconds in Example 24 (C).

EXAMPLE 26

A thermal recording material was obtained in the same manner as in Example 24 except that the drying was carried out by blowing hot air at 90° C. for 2 minutes instead of blowing the hot air at 180° C. for 30 seconds in Example 24 (C).

EXAMPLE 27

A thermal recording material was obtained in the same manner as in Example 24 except that the drying was carried out by blowing dehumidified air having a temperature of 40° C and a dew point of −10° C. for 2 minutes instead of blowing the hot air at 180° C. for 30 seconds in Example 24 (C).

EXAMPLE 28

A thermal recording material was obtained in the same manner as in Example 24 except that the drying was carried out by irradiating the coated surface with infrared ray for 1 minute instead of blowing the hot air at 180° C. for 30 seconds in Example 24 (C).

EXAMPLE 29

A thermal recording material was obtained in the same manner as in Example 24 except that the drying was carried out by irradiating the coated surface with microwaves for 1 minute instead of blowing the hot air at 180° C. for 30 seconds in Example 24 (C).

EXAMPLE 30

(D) Preparation of Undercoat Layer Coating Color

An undercoat layer coating color having a viscosity of 100 mPa·s and a surface tension of 30 mN/m was prepared in the same manner as in Example 24 (A).

(E) Preparation of Coating Color for Heat-Sensitive Recording Layer

A heat-sensitive recording layer coating color having a viscosity of 100 mPa·s and a surface tension of 30 mN/m was prepared in the same manner as in Example 24 (B).

(F) Preparation of Protective Layer Coating Color

A mixture solution having the following composition was dispersed with a ball mill, to obtain a dispersion F having a volume average particle diameter of 1 $\mu$m.

| | |
|---|---|
| Dispersion F: | |
| Aluminum hydroxide (Higilite H42, supplied by Showa Denko K.K.) | 6 parts |
| Sodium polyacrylate | 0.1 part |
| Water | 13.9 parts |

The above-obtained dispersion F, 25 parts of a 40% zinc stearate dispersion, 1,000 parts of a 10% polyvinyl alcohol aqueous solution, 244 parts of water and 0.90 part of a fluorine-containing surfactant (Surflon S-111, supplied by Asahi Glass Co., Ltd.) were mixed, to prepare a protective layer coating color having a viscosity of 100 mPa·s and a surface tension of 25 mN/m.

(G) Preparation of Thermal Recording Material

With a slide hopper type curtain coater, the undercoat layer coating color, the heat-sensitive recording layer coating color and the protective layer coating color prepared in the above (D), (E) and (F) were formed into a coating composition film made of an under coat layer coating color, a heat-sensitive recording layer coating color and a protective layer in this order from a lower layer side to be brought into contact with a substrate, and the coating composition film was applied onto a woodfree paper having a basis weight of 60 g/m$^2$ such that the solid application amount for an undercoat layer was 8 g/m$^2$, that the solid application amount for a heat-sensitive recording layer was 6 g/m$^2$ and that the solid application amount for a protective layer was 2 g/m$^2$, followed by drying by blowing hot air at 180° C. for 45 seconds immediately after the application thereof, whereby a thermal recording material was obtained.

EXAMPLE 31

(H) Preparation of Coating Color for Second Ink Receptor Layer

A mixture solution having the following composition was stirred with a homomixer, to obtain a second ink receptor layer coating color having a viscosity of 100 mPa·s and a surface tension of 35 mN/m.

Second Ink Receptor Layer Coating Color:

| | |
|---|---|
| Synthetic amorphous silica (Mizukasil P78D, supplied by Mizusawa Kagaku) | 28 parts |
| 10% Polyvinyl alcohol aqueous solution | 55 parts |
| Water | 117 parts |
| Fluorine-containing surfactant (Surflon S-111, supplied by Asahi Glass Co., Ltd.) | 0.04 part |

(I) Preparation of Coating Color for First Ink Receptor Layer

A mixture solution having the following composition was stirred with a homomixer, to obtain a first ink receptor layer coating color having a viscosity of 100 mPa·s and a surface tension of 35 mN/m.

First Ink receptor Layer Coating Color:

| | |
|---|---|
| Synthetic amorphous silica (Fineseal X37B, supplied by Tokuyama) | 21 parts |
| 10% polyvinyl alcohol aqueous solution | 63 parts |
| Cationic polymer (Sumilese Resin 1001, supplied by Sumitomo Chemical Co., Ltd.) | 14 parts |
| Water | 102 parts |
| Fluorine-containing surfactant (Surflon S-111, supplied by Asahi Glass Co., Ltd.) | 0.002 parts |

(J) Preparation of Inkjet Recording Material

With a slide hopper type curtain coater, the second ink receptor layer coating color and the first ink receptor layer coating color prepared in the above (H) and (I) were formed into a coating composition film made of the second ink receptor layer coating color and the first ink receptor layer coating color in this order from a lower layer side to be brought into contact with a substrate, and the coating composition film was applied onto a woodfree paper having a basis weight of 60 g/m$^2$ such that the solid application amount of the second ink receptor layer coating color was 30 g/M$^2$ and that the solid application amount of the first ink receptor layer coating color was 9 g/m$^2$, followed by drying by blowing hot air at 180° C. for 2 minutes immediately after the application thereof, whereby an inkjet recording material was obtained.

EXAMPLE 32

An inkjet recording material was prepared in the same manner as in Example 31 except that the drying was carried out both by irradiating the coated surface with infrared ray and by blowing hot air at 180° C. for 1 minute instead of blowing hot air at 180° C. for 2 minutes in Example 31 (J).

EXAMPLE 33

A thermal recording material was prepared in the same manner as in Example 24 except that the drying was carried out by blowing hot air at 80° C. for 2 minutes and 30 seconds instead of blowing hot air at 180° C. for 30 seconds in Example 24 (C).

EXAMPLE 34

A thermal recording material was prepared in the same manner as in Example 24 except that the drying was carried out by blowing hot air at 60° C. for 4 minutes instead of blowing hot air at 180° C. for 30 seconds in Example 24 (C).

EXAMPLE 35

A thermal recording material was obtained in the same manner as in Example 24 except that the drying was carried out by blowing dehumidified air having a temperature of 40° C and a dew point of 5° C. for 3 minutes instead of blowing the hot air at 180° C. for 30 seconds in Example 24 (C).

EXAMPLE 36

A thermal recording material was obtained in the same manner as in Example 30 except that the drying was carried out by blowing hot air at 80° C. for 3 minutes instead of blowing the hot air at 180° C. for 45 seconds in Example 30 (G).

EXAMPLE 37

An inkjet recording material was obtained in the same manner as in Example 31 except that the drying was carried out by blowing hot air at 80° C. for 10 minutes instead of blowing the hot air at 180° C. for 2 minutes in Example 31 (J).

Test 4: Printing on Thermal Recording Material with Thermal Head

A print having a width of 5 cm and a length of 5 cm was made on each of the thermal recording materials obtained in Examples 24 to 30 and 33 to 36 with a thermal facsimile printing test machine (TH-PMD, supplied by Okura Denki K.K.) equipped with a printing head (LH4409, supplied by TDK) at an application pulse of 1.1 milliseconds and an applied voltage of 20 V. Each printed portion was measured for a density with a densitometer (Macbeth RD918). Further, the printed portions were visually observed for a color formation state. Table 5 shows the results.

Test 5: Test of Protective Layer of Thermal Recording Material for Barrier Properties A print having a width of 5 cm and a length of 5 cm was made on each of the thermal recording materials obtained in Examples 30 and 36 with a thermal facsimile printing test machine (TH-PMD, supplied by Okura Denki K.K.) equipped with a printing head (LH4409, supplied by TDK) at an application pulse of 1.1 milliseconds and an applied voltage of 20 V. Then, castor oil was applied on each printed portion, and after 2 hours, the printed portions were measured for a density with a densitometer (Macbeth RD918). Table 6 shows the results.

Test 6: Printing on Inkjet Recording Material with Inkjet Printer

A print having a width of 5 cm and a length of 5 cm was made on each of the inkjet recording materials obtained in Examples 31, 32 and 37 with a black ink with a color inkjet printer (PM750C, supplied by Seiko-Epson). Each printed portion was measured for a density with a densitometer (Macbeth RD918). Further, the printed portions were visually observed for a color formation state. Table 7 shows the results.

TABLE 5

| | Print density | Color formation state |
|---|---|---|
| Ex. 24 | 1.35 | Dense, clear and black color formation was obtained. |
| Ex. 25 | 1.34 | Dense, clear and black color formation was obtained. |
| Ex. 26 | 1.31 | Dense, clear and black color formation was obtained. |
| Ex. 27 | 1.32 | Dense, clear and black color formation was obtained. |
| Ex. 28 | 1.36 | Dense, clear and black color formation was obtained. |
| Ex. 29 | 1.38 | Dense, clear and black color formation was obtained. |
| Ex. 30 | 1.29 | Dense, clear and black color formation was obtained. |
| Ex. 33 | 1.25 | Slightly grayish black color formation was obtained. |
| Ex. 34 | 1.22 | Slightly grayish black color formation was obtained. |
| Ex. 35 | 1.24 | Slightly grayish black color formation was obtained. |
| Ex. 36 | 1.15 | Grayish black color formation with printing non-uniformity was obtained. |

Ex. = Example

TABLE 6

| | Density of castor-oil-applied portion |
|---|---|
| Example 30 | 1.29 |
| Example 36 | 0.60 |

TABLE 7

| | Print density | Color formation state |
|---|---|---|
| Ex. 31 | 1.81 | Dense, clear and black color formation was obtained. |
| Ex. 32 | 1.85 | Dense, clear and black color formation was obtained. |
| Ex. 37 | 1.70 | Slightly grayish black color formation was obtained. |

Ex. = Example

As shown in Examples 24 to 32 in Tables 5 to 7, information recording materials excellent in coating qualities and excellent in various properties were obtained with good productivity by curtain-coating coating composition films made of a plurality of coating color layers each and drying the coating composition films within 2 minutes after the application thereof. In contrast, in Examples 33 to 37, it took longer than 2 minutes to dry the applied coating composition films after the application thereof, and as a result, the products in Examples 33 to 37 were poor in coating qualities as compared with those in Examples 24 to 32.

The above data shows that it is preferred to complete the drying of the coating composition film within 2 minutes after its application.

EXAMPLE 38

(A) Preparation of Undercoat Layer Coating Color

A mixture solution having the following composition was stirred with a homomixer, to prepare an undercoat layer coating color having a viscosity of 100 mPa·s and a surface tension of 30 mN/m.

Undercoat Layer Coating Color:

| | |
|---|---|
| Calcined kaolin (Ansilex, supplied by Engelhard) | 100 parts |
| 50% Styrene-butadiene copolymer latex | 24 parts |
| 10% Starch aqueous solution (MS4600, supplied by Nippon Shokuhin Kako) | 60 parts |
| Sodium polyacrylate | 2 parts |
| Water | 116 parts |
| Fluorine-containing surfactant (Surflon S-111, supplied by Asahi Glass Co., Ltd.) | 0.51 part |

(B) Preparation of Coating Color for Heat-sensitive Recording Layer

A mixture solution having the following composition was dispersed with a ball mill, to prepare dispersions B1, B2 and B3 having a volume average particle diameter of 1 $\mu$m and a dispersion B4 having a volume average particle diameter of 2 $\mu$m.

| | |
|---|---|
| Dispersion B1: | |
| 3-Dibutylamino-6-methyl-7-anilinofluorane | 40 parts |
| 10% Polyvinyl alcohol aqueous solution | 20 parts |
| Water | 40 parts |
| Dispersion B2: | |
| 4,4'-bis (Hydroxyphenyl) sulfone | 80 parts |
| 10% Polyvinyl alcohol aqueous solution | 40 parts |
| Water | 80 parts |
| Dispersion B3: | |
| 2-Benzyloxynaphthalene | 80 parts |
| 10% Polyvinyl alcohol aqueous solution | 40 parts |
| Water | 80 parts |
| Dispersion B4: | |
| Calcium carbonate (Callight SA, supplied by Shiraishi Kogyo) | 80 parts |
| Sodium polyacryalte | 1 part |
| Water | 79 parts |

The above-obtained dispersion B1, B2, B3 and B4 800 parts of a 10% polyvinyl alcohol aqueous solution, 105 parts of water and 0.67 part of a fluorine-containing surfactant (Surflon S-111, supplied by Asahi Glass Co., Ltd.) were mixed, to obtain a heat-sensitive recording layer coating color having a viscosity of 100 mPa·s and a surface tension of 30 mN/m.

(C) Preparation of Thermal Recording Material

With a slide hopper type curtain coater, the undercoat layer coating color and the heat-sensitive recording layer coating color prepared in the above (A) and (B) were formed into a coating composition film made of an undercoat layer coating color and a heat-sensitive recording layer coating color in this order to be brought into contact with a substrate, and the coating composition film was applied onto a wood-free paper having a basis weight of 60 g/m$^2$ such that the solid application amount for an undercoat layer was 8 g/m$^2$ and that the solid application amount for a heat-sensitive recording layer was 6 g/m$^2$, followed by drying in a state where the substrate and a horizontal plane formed an angle of 0 degrees and the coating composition film was on the upper side of the substrate, whereby a thermal recording material was obtained.

EXAMPLE 39

A thermal recording material was prepared in the same manner as in Example 38 except that the drying was carried out in a state where the substrate and a horizontal plane formed an angle of 20 degrees and the coating composition film was on the upper side of the substrate instead of carrying out the drying in a state where the substrate and a horizontal plane formed an angle of 0 degrees and the coating composition film was on the upper side of the substrate in Example 38 (C).

EXAMPLE 40

A thermal recording material was prepared in the same manner as in Example 38 except that the drying was carried out in a state where the substrate and a horizontal plane formed an angle of 45 degrees and the coating composition film was on the upper side of the substrate instead of carrying out the drying in a state where the substrate and a horizontal plane formed an angle of 0 degrees and the coating composition film was on the upper side of the substrate in Example 38 (C).

EXAMPLE 41

(D) Preparation of Coating Color for Second Ink Receptor Layer:

A mixture solution having the following composition was stirred with a homomixer, to obtain a second ink receptor layer coating color having a viscosity of 100 mPa·s and a surface tension of 35 mN/m.

Second Ink Receptor Layer Coating Color:

| | |
|---|---|
| Synthetic amorphous silica (Mizukasil P78D, supplied by Mizusawa Kagaku) | 28 parts |
| 10% Polyvinyl alcohol aqueous solution | 55 parts |
| Water | 117 parts |
| Fluorine-containing surfactant (Surflon S-111, supplied by Asahi Glass Co., Ltd.) | 0.04 part |

(E) Preparation of Coating Color for First Ink Receptor Layer:

A mixture solution having the following composition was stirred with a homomixer, to obtain a first ink receptor layer coating color having a viscosity of 100 mPa·s and a surface tension of 35 mN/m.

First Ink Receptor Layer Coating Color:

| | |
|---|---|
| Synthetic amorphous silica (Fineseal X37B, supplied by Tokuyama) | 21 parts |
| 10% polyvinyl alcohol aqueous solution | 63 parts |
| Cationic polymer (Sumilese Resin 1001, supplied by Sumitomo Chemical Co., Ltd.) | 14 parts |
| Water | 102 parts |
| Fluorine-containing surfactant (Surflon S-111, supplied by Asahi Glass Co., Ltd.) | 0.002 parts |

(F) Preparation of Inkjet Recording Material

With a slide hopper type curtain coater, the second ink receptor layer coating color and the first ink receptor layer coating color prepared in the above (D) and (E) were formed into a coating composition film made of the second ink receptor layer coating color and the first ink receptor layer coating color in this order from a lower layer side to be brought into contact with a substrate, and the coating composition film was applied onto a woodfree paper having a basis weight of 60 g/m$^2$ such that the solid application amount of the second ink receptor layer coating color was 30 g/m$^2$ and that the solid application amount of the first ink receptor layer coating color was 9 g/m$^2$, followed by drying in a state where the substrate and a horizontal plane formed an angle of 0 degrees and the coating composition film was on the upper side of the substrate, whereby an inkjet recording material was obtained.

EXAMPLE 42

An inkjet recording material was prepared in the same manner as in Example 41 except that the drying was carried out in a state where the substrate and a horizontal plane formed an angle of 20 degrees and the coating composition film was on the upper side of the substrate instead of carrying out the drying in a state where the substrate and a horizontal plane formed an angle of 0 degrees and the coating composition film was on the upper side of the substrate in Example 41 (F).

EXAMPLE 43

An inkjet recording material was prepared in the same manner as in Example 41 except that the drying was carried out in a state where the substrate and a horizontal plane formed an angle of 45 degrees and the coating composition film was on the upper side of the substrate instead of carrying out the drying in a state where the substrate and a horizontal plane formed an angle of 0 degrees and the coating composition film was on the upper side of the substrate in Example 41 (F).

EXAMPLE 44

A thermal recording material was prepared in the same manner as in Example 38 except that the drying was carried out in a state where the substrate and a horizontal plane formed an angle of 60 degrees and the coating composition film was on the upper side of the substrate instead of carrying out the drying in a state where the substrate and a horizontal plane formed an angle of 0 degrees and the coating composition film was on the upper side of the substrate in Example 38 (C).

EXAMPLE 45

A thermal recording material was prepared in the same manner as in Example 38 except that the drying was carried out in a state where the substrate and a horizontal plane formed an angle of 90 degrees instead of carrying out the drying in a state where the substrate and a horizontal plane formed an angle of 0 degrees and the coating composition film was on the upper side of the substrate in Example 38 (C).

EXAMPLE 46

An inkjet recording material was prepared in the same manner as in Example 41 except that the drying was carried out in a state where the substrate and a horizontal plane formed an angle of 60 degrees and the coating composition film was on the upper side of the substrate instead of carrying out the drying in a state where the substrate and a horizontal plane formed an angle of 0 degrees and the coating composition film was on the upper side of the substrate in Example 41 (F).

EXAMPLE 47

An inkjet recording material was prepared in the same manner as in Example 41 except that the drying was carried out in a state where the substrate and a horizontal plane formed an angle of 90 degrees instead of carrying out the drying in a state where the substrate and a horizontal plane formed an angle of 0 degrees and the coating composition film was on the upper side of the substrate in Example 41 (F).

Test 7: Printing on Thermal Recording Material with Thermal Head

A print having a width of 5 cm and a length of 5 cm was made on each of the thermal recording materials obtained in Examples 38 to 40, 44 and 45 with a thermal facsimile printing test machine (TH-PMD, supplied by Okura Denki K.K.) equipped with a printing head (LH4409, supplied by TDK) at an application pulse of 1.1 milliseconds and an applied voltage of 20 V. Each printed portion was measured for a density with a densitometer (Macbeth RD918). Further, the printed portions were visually observed for a color formation state. Table 8 shows the results.

Test 8: Printing on Inkjet Recording Material with Inkjet Printer

A print having a width of 5 cm and a length of 5 cm was made on each of the inkjet recording materials obtained in Examples 41 to 43, 46 and 47 with a black ink with a color inkjet printer (PM750C, supplied by Seiko-Epson). Each printed portion was measured for a density with a densitometer (Macbeth RD918). Further, the printed portions were visually observed for a color formation state. Table 9 shows the results.

TABLE 8

| | Print density | Color formation state |
|---|---|---|
| Ex. 38 | 1.34 | Dense, clear and black color formation was obtained. |
| Ex. 39 | 1.33 | Dense, clear and black color formation was obtained. |
| Ex. 40 | 1.31 | Dense, clear and black color formation was obtained. |
| Ex. 44 | 1.22 | Slightly grayish black color formation was obtained. |
| Ex. 45 | 1.12 | Slightly grayish black color formation was obtained. |

Ex. = Example

TABLE 9

| | Print density | Color formation state |
|---|---|---|
| Ex. 41 | 1.81 | Dense, clear and black color formation was obtained. |
| Ex. 42 | 1.80 | Dense, clear and black color formation was obtained. |
| Ex. 43 | 1.77 | Dense, clear and black color formation was obtained. |
| Ex. 46 | 1.69 | Slightly grayish black color formation was obtained. |
| Ex. 47 | 1.53 | Slightly grayish black color formation was obtained. |

Ex. = Example

As shown in Examples 38 to 43 shown in Tables 8 and 9, information recording materials excellent in coating qualities and excellent in various properties were obtained with good productivity by curtain-coating the coating composition films made of a plurality of coating color layers and thereafter drying the coating composition films in a state where the substrate and the horizontal plane formed an angle of 45 degrees or less.

In contrast, in Examples 44 to 47, the drying was carried out in a state where the substrate and the horizontal plane formed an angle of more than 45 degrees, and as a result, the products in Examples 44 to 47 were poor in coating qualities as compared with those in 38 to 43.

Is therefore seen that it is desirable to dry the coating composition film in a state where the angle formed by the substrate and the horizontal plane does not exceed 45 degrees.

EXAMPLE 48

(A) Preparation of Undercoat Layer Coating Color

A mixture solution having the following composition was stirred with a homomixer, to prepare an undercoat layer coating color having a viscosity of 1,000 mPa·s and a surface tension of 30 mN/m and a density of 1.26 g/cm$^3$.

Undercoat Layer Coating Color:

| | |
|---|---|
| Calcined kaolin (Ansilex, supplied by Engelhard) | 100 parts |
| 50% Styrene-butadiene copolymer latex | 24 parts |
| 10% Starch aqueous solution (MS4600, supplied by Nippon Shokuhin Kako) | 60 parts |
| Sodium polyacrylate | 2 parts |
| Water | 116 parts |
| 30% Polyacrylamide aqueous solution (Polymine AE70 supplied by BASF) | 2.3 parts |
| Fluorine-containing surfactant (Surflon S-111, supplied by Asahi Glass Co., Ltd.) | 0.51 part |

(B) Preparation of Coating Color for Heat-Sensitive Recording Layer

A mixture solution having the following composition was dispersed with a ball mill, to prepare dispersions B1, B2 and B3 having a volume average particle diameter of 1 $\mu$m and a dispersion B4 having a volume average particle diameter of 2 $\mu$m.

| | |
|---|---|
| Dispersion B1: | |
| 3-Dibutylamino-6-methyl-7-anilinofluorane | 40 parts |
| 10% Polyvinyl alcohol aqueous solution | 20 parts |
| Water | 40 parts |
| Dispersion B2: | |
| 4,4'-bis (Hydroxyphenyl) sulfone | 80 parts |
| 10% Polyvinyl alcohol aqueous solution | 40 parts |
| Water | 80 parts |
| Dispersion B3: | |
| 2-Benzyloxynaphthalene | 80 parts |
| 10% Polyvinyl alcohol aqueous solution | 40 parts |
| Water | 80 parts |
| Dispersion B4: | |
| Calcium carbonate (Callight SA, supplied by Shiraishi Kogyo) | 80 parts |
| Sodium polyacryalte | 1 part |
| Water | 79 parts |

The above-obtained dispersions B1, B2, B3 and B4, 800 parts of a 10% polyvinyl alcohol aqueous solution, 105 parts of water and 0.67 part of a fluorine-containing surfactant (Surflon S-111, supplied by Asahi Glass Co., Ltd.) and 6.7 parts of a 30% polyacrylamide aqueous solution (Polymine AE70 supplied by BASF) were mixed, to obtain a heat-sensitive recording layer coating color having a viscosity of 100 mPa·s and a surface tension of 30 mN/m and a density of 1.03 g/cm$^3$.

(C) Preparation of Thermal Recording Material

With a slide hopper type curtain coater, the undercoat layer coating color and the heat-sensitive recording layer coating color prepared in the above (A) and (B) were formed into a coating composition film made of an undercoat layer coating color and a heat-sensitive recording layer coating color in this order from a lower layer side to be brought into contact with a substrate, and the coating composition film was applied onto a woodfree paper having a basis weight of 60 g/m$^2$ such that the solid application amount for an undercoat layer was 8 g/m$^2$ and that the solid application amount for a heat-sensitive recording layer was 6 g/m$^2$, followed by drying by blowing hot air at 180° C. for 30 seconds immediately after the application thereof, in a state where the substrate and a horizontal plane formed an angle of 0 degrees and the coating composition film was on the upper side of the substrate, whereby a thermal recording material was obtained.

EXAMPLE 49

(G) Preparation of Coating Color for Second Ink Receptor Layer:

A mixture solution having the following composition was stirred with a homomixer, and the surface tension of the solution was adjusted by adding a fluorine-containing surfactant (Surflon S-111, supplied by Asahi Glass Co., Ltd.), to obtain a second ink receptor layer coating color having a viscosity of 100 mPa·s and a surface tension of 35 mN/m and a density of 1.02 g/cm$^3$.

Second Ink Receptor Layer Coating Color:

| | |
|---|---|
| Synthetic amorphous silica (Mizukasil P78D, supplied by Mizusawa Kagaku) | 28 parts |
| 10% Polyvinyl alcohol aqueous solution | 55 parts |
| Water | 117 parts |
| Fluorine-containing surfactant (Surflon S-111, supplied by Asahi Glass Co., Ltd.) | 0.04 part |

(H) Preparation of Coating Color for First Ink Receptor Layer:

A mixture solution having the following composition was stirred with a homomixer, and the surface tension of the solution was adjusted by adding a fluorine-containing surfactant (Surflon S-111, supplied by Asahi Glass Co., Ltd.), to obtain a first ink receptor layer coating color having a viscosity of 100 mPa·s, a surface tension of 35 mN/m and a density of 1.03 g/cm$^3$.

First Ink Receptor Layer Coating Color:

| | |
|---|---|
| Synthetic amorphous silica (Fineseal X37B, supplied by Tokuyama) | 21 parts |
| 10% polyvinyl alcohol aqueous solution | 63 parts |
| Cationic polymer (Sumilese Resin 1001, supplied by Sumitomo Chemical Co., Ltd.) | 14 parts |
| Water | 102 parts |
| Fluorine-containing surfactant (Surflon S-111, supplied by Asahi Glass Co., Ltd.) | 0.002 parts |

(I) Preparation of Inkjet Recording Material

With a slide hopper type curtain coater, the second ink receptor layer coating color and the first ink receptor layer coating color prepared in the above (G) and (H) were formed into a coating composition film made of the second ink receptor layer coating color and the first ink receptor layer coating color in this order from a lower layer side to be brought into contact with a substrate, and the coating composition film was applied onto a woodfree paper having a basis weight of 60 g/m$^2$ such that the solid application amount of the second ink receptor layer coating color was 30 g/m$^2$ and that the solid application amount of the first ink receptor layer coating color was 9 g/m$^2$, followed by drying by blowing hot air at 180° C. for 2 minutes immediately after the application thereof, in a state where the substrate and a horizontal plane formed an angle of 0 degrees and the coating composition film was on the upper side of the substrate, whereby an inkjet recording material was obtained.

Test 9: Printing on Thermal Recording Material with Thermal Head

A print having a width of 5 cm and a length of 5 cm was made on each of the thermal recording materials obtained in Example 48 with a thermal facsimile printing test machine (TH-PMD, supplied by Okura Denki K.K.) equipped with a printing head (LH4409, supplied by TDK) at an application pulse of 1.1 milliseconds and an applied voltage of 20 V. Each printed portion was measured for a density with a densitometer (Macbeth RD918). Further, the printed portions were visually observed for a color formation state. Table 10 shows the results.

Test 10: Printing on Inkjet Recording Material with Inkjet Printer

A print having a width of 5 cm and a length of 5 cm was made on each of the inkjet recording materials obtained in Example 49 with a black ink with a color inkjet printer (PM750C, supplied by Seiko-Epson). Each printed portion was measured for a density with a densitometer (Macbeth RD918). Further, the printed portions were visually observed for a color formation state. Table 11 shows the results.

TABLE 10

| | Print density | Color formation state |
|---|---|---|
| Ex. 48 | 1.47 | Dense, clear and black color formation was obtained. |

Ex. = Example

TABLE 11

| | Print density | Color formation state |
|---|---|---|
| Ex. 49 | 1.89 | Dense, clear and black color formation was obtained. |

Ex. = Example

As shown in Examples 48 and 49 shown in Tables 10 and 11, information recording materials excellent in best coating qualities and excellent in various properties were obtained with good productivity by curtain-coating the coating composition films made of a plurality of coating color layers and thereafter drying the coating composition films within 2 minutes in a state where the substrate and the horizontal plane formed an angle of 45 degrees or less.

In the above, the coating colors have a viscosity of at least 100 mPa·s during application, the coating color for the lowermost layer of a plurality of the coating color layers has a surface tension of 18 to 45 mN/m and the coating color for a layer to be positioned above has a density which does not exceed 140% of the density of the coating color for an adjacent layer to be positioned below.

What is claimed is:

1. A method of producing an inkjet recording material having paper as a substrate and at least two layers coated on the substrate, which comprises forming a coating composition film made of a plurality of coating mixture layers on the substrate by curtain coating and drying the coating composition film, to form part or all of layers for forming the inkjet recording material, wherein the coating composition film is dried in a state where the density of the coating mixture for a layer to be positioned above is 100% or less of the density of the coating mixture for an adjacent layer to be positioned below.

2. The method of claim 1, wherein the coating composition film made of a plurality of coating mixture layers is dried in a state where the substrate and a horizontal plane form an angle of 45 degrees or less.

3. The method of claim 1, wherein the coating composition film is dried within 2 minutes after the coating composition film of a plurality of the coating mixture layers is formed on the substrate.

4. The method of claim 3, wherein the coating composition film is dried by irradiation with infrared rays.

5. The method of claim 3, wherein the coating composition film is dried by irradiation with microwaves.

6. The method of claim 3, wherein the coating composition film composed of a plurality of coating mixture layers formed on the substrate by curtain coating is a film for forming a plurality of ink receptor layers.

7. The method of claim 1, wherein the coating mixtures for a plurality of the coating fixture layers have a viscosity of at least 100 mPa·s and the coating mixture for the lowermost layer of a plurality of the coating mixture layers has a surface tension of 18 to 45 mN/m.

8. The method of claim 1, wherein, of the coating mixture layers, a coating mixture layer for forming an upper layer has a smaller surface tension than a coating mixture layer for forming a lower layer.

* * * * *